US005741009A

United States Patent [19]

Kawano et al.

[11] Patent Number: 5,741,009

[45] Date of Patent: Apr. 21, 1998

[54] SHEET SORTING APPARATUS

[75] Inventors: Minoru Kawano, Hachioji; Masaaki Sekiguchi, Asaka; Shigemi Yukizane, Chofu; Hirotaka Kataoka, Kawaguchi; Hirohiko Okabe, Tokorozawa; Yoshiyuki Kikuiri, Tokyo, all of Japan

[73] Assignee: Konica Corporation, Japan

[21] Appl. No.: 526,628

[22] Filed: Sep. 11, 1995

[30] Foreign Application Priority Data

Sep. 14, 1994 [JP] Japan ..... 6-220296
Sep. 28, 1994 [JP] Japan ..... 6-233430

[51] Int. Cl.[6] ..... B65H 29/68

[52] U.S. Cl. ..... 271/182; 271/213; 271/214

[58] Field of Search ..... 271/182, 314, 271/207, 213, 214, 220, 176

[56] References Cited

U.S. PATENT DOCUMENTS 5,056,774 10/1991 Kubota et al. .
5,116,042 5/1992 Hamanaka ..... 271/182 X
5,215,300 6/1993 Hiroi et al. ..... 271/213 X
5,316,287 5/1994 Hiroi et al. .
5,513,839 5/1996 Green ..... 271/207 X

FOREIGN PATENT DOCUMENTS 0346851 12/1989 European Pat. Off. .
61-291372 12/1986 Japan ..... 271/314
62-16982 1/1987 Japan ..... 271/314
62-105864 5/1987 Japan ..... 271/207
63-116168 5/1988 Japan .
336662 1/1991 Japan .
2161458 1/1986 United Kingdom .

*Primary Examiner*—David H. Bollinger
*Attorney, Agent, or Firm*—Jordan B. Bierman; Bierman, Muserlian and Lucas

[57] ABSTRACT

An apparatus for sorting sheets on a tray in which a stacking position of sheets is changed for each set number of sheets to one of different stacking positions on the tray, includes a movable pressing member coming in contact with a discharging roller on its low position so that a discharging speed of the sheet is reduced, a movable lower guide plate so that the lower guide plate is positioned lower than a upper portion of the discharging roller on its low position; a sensor to detect a passage of a sheet; and a driving device to move the lower guide plate and the pressing member in response to a signal from the sensor.

16 Claims, 18 Drawing Sheets

FIG. 8 ( A )
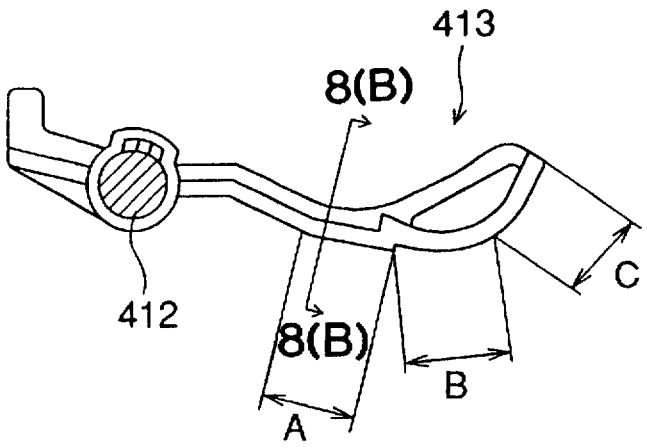
FIG. 8 ( B )
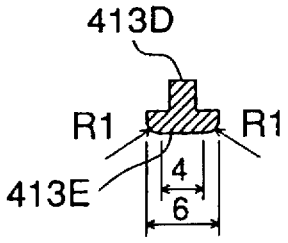

FIG. 13 ( A )
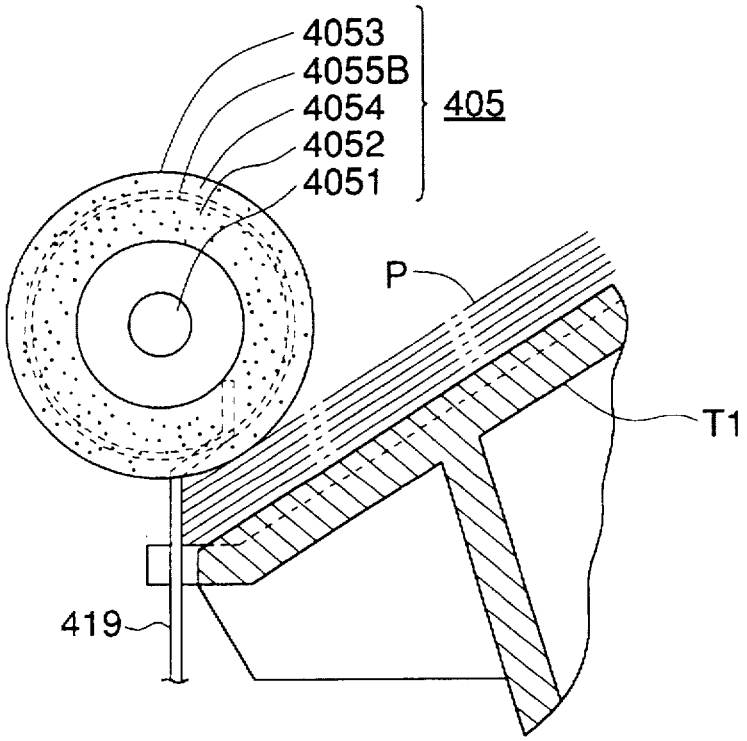
FIG. 13 ( B )
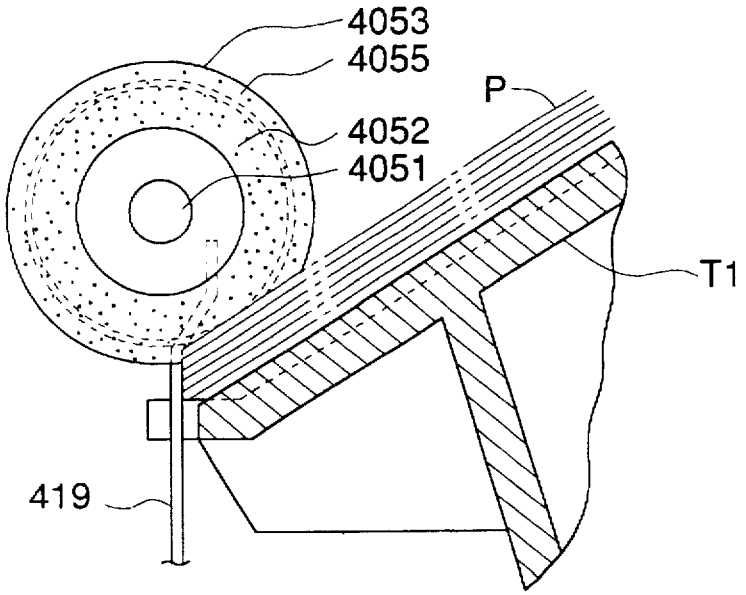

FIG. 15 ( A )
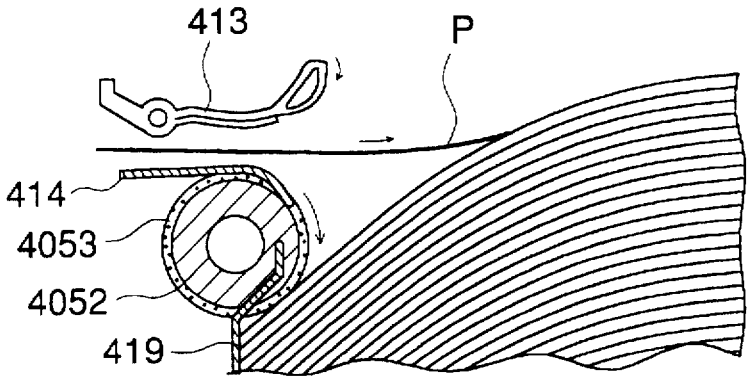
FIG. 15 ( B )
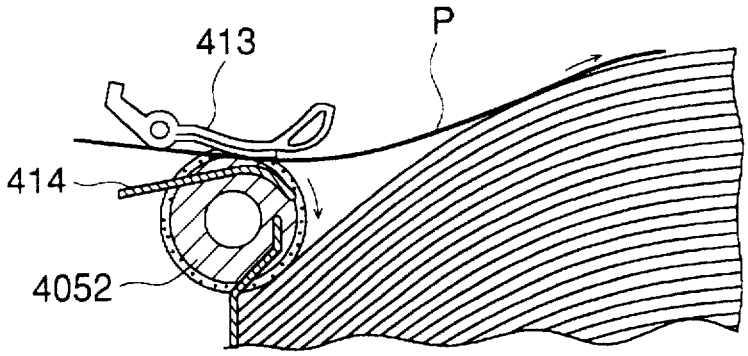
FIG. 15 ( C )
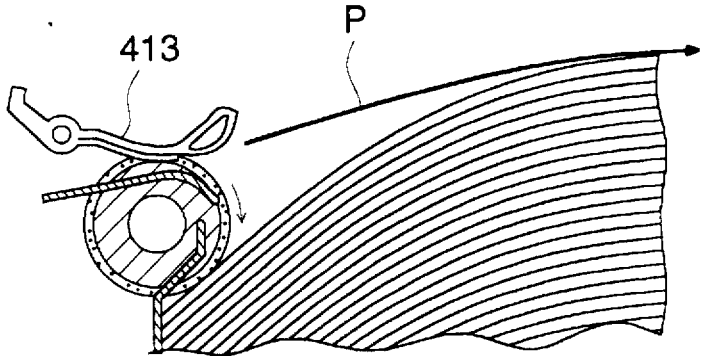

FIG. 16 ( A )
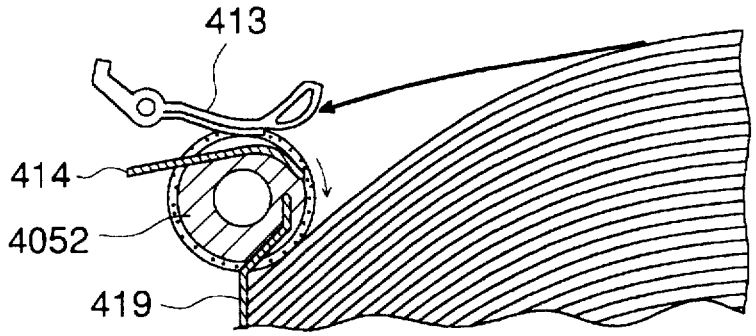
FIG. 16 ( B )
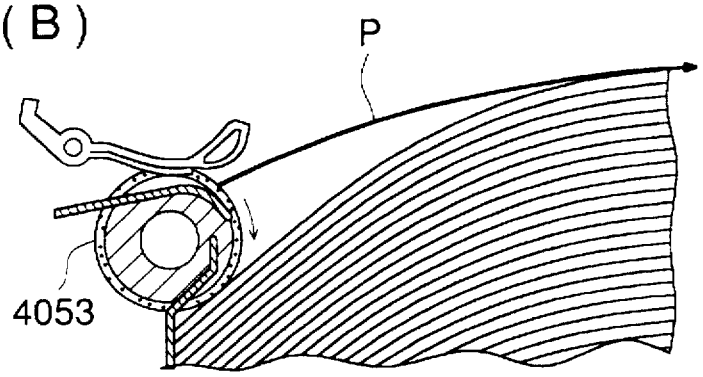
FIG. 16 ( C )
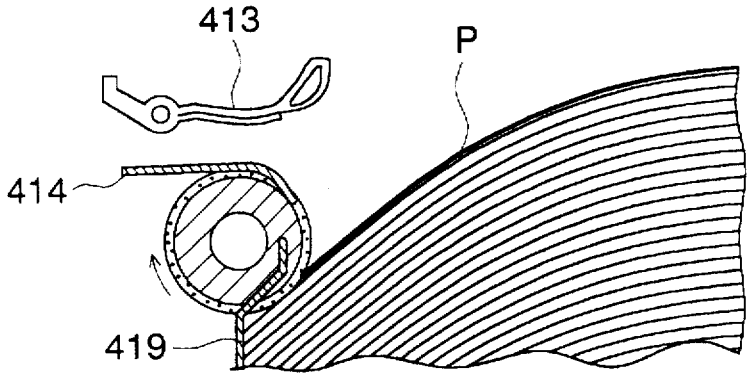

SHEET SORTING APPARATUS

BACKGROUND OF THE INVENTION

The present invention relates to a sheet sorter for sorting recording sheets on which images have been recorded by an image forming apparatus such as an electrophotographic copier or printer so that the recording sheets can be sorted for each setting number of sheets on a sheet discharge tray. More particularly, the present invention relates to a sheet sorter for sorting recording sheets appropriately attached to an image forming apparatus of high processing speed and an after-processing apparatus to process the recording sheets.

In Japanese Patent Publication Open to Public Inspection Nos. 16982/1987, 116168/1988 and 3662/1991, the following sheet sorter is disclosed. Recording sheets on which images have been formed are sorted on a discharge tray for each setting number of recording sheets. A recording sheet discharged along the conveyance path is held by a pair of rollers and shifted by a shift means in a direction perpendicular to the sheet discharge direction. A discharge means is arranged in the downstream of the shift means in the sheet discharge direction. The discharge means holds and discharges a recording sheet onto the sheet discharge tray, and the sheet discharge position is changed for each setting number of recording sheets so that the recording sheets can be sorted.

In this type sheet sorter, recording sheets are sorted in the following manner. First, a recording sheet is shifted in the transverse direction by the shift means by which a pair of roller shafts are moved in parallel with the thrust direction so as to shift the recording sheet. After a trailing end of the recording sheet has passed through the shift means, the recording sheet is held by the sheet discharge means arranged in the downstream of the sheet conveyance direction, so that the recording sheet is discharged onto the sheet discharge tray. When this motion is repeated, the successive sheets are sorted on the sheet discharge tray for each setting number of the recording sheets.

On the other hand, a plurality of sheets on which image have been formed are collated for each copy number and stapled by a stapler. This operation is conducted by a sheet after-processing device referred to as a finisher. This finisher is connected with the main body of the image forming apparatus. Therefore, the finisher is driven in accordance with the sequential operation of the copy process. Accordingly, for an image forming apparatus capable of processing at high speed, it is necessary to provide a finisher of high processing speed.

Such a finisher of high processing speed is provided with a recording sheet sorter of high capacity by which a large number of sheets can be sorted. In the case of an image forming apparatus in which a large number of copies are made, the above sheet sorter is provided for automatically collating and sorting the recording sheets on which images have been recorded.

However, in these sheet sorters, the following problems may be encountered. When a sheet discharged from the shift means passes through a sheet discharge means in a separating condition, for example, when a sheet discharged from the shift means passes through between a pair of sheet discharge rollers, a leading end of the sheet collides with an upper or lower roller of the pair of sheet discharge rollers, so that the leading end of the sheet is damaged or the sheet is not smoothly discharged.

Further, it is difficult to maintain the contact pressure of the pair of rollers to be constant with respect to the overall width of the sheet. Especially, in the case of a plurality of pushing levers in which the upper roller is fixed to a shaft, it is difficult to maintain the contact pressure of each pushing lever with the lower roller to be constant because of the influences of accuracy of parts and assembly and also because of deflection of the shaft. Since the contact forces become uneven, the conveyance force of the sheet fluctuates in the sheet width direction, which could be the causes of skew and wrinkles of a conveyed sheet.

When a drive force (for example, an electromagnetic solenoid) for oscillating the above pushing lever is attached to the stationary frame of the sheet sorter, it is difficult to maintain a stroke of the solenoid to be constant. Further, when the stroke is extended, the capacity and dimensions of the solenoid are increased, and the structure of the drive force transmission means becomes complicated.

Furthermore, the following problems may be encountered. When a sheet is discharged from a pressure-contact position formed between the discharge roller and the pushing lever, the trailing end of the sheet is whirled up, so that the stacked sheets are not appropriately aligned, and further when a sheet slides down on the sheet discharge tray by its own weight, the sheet does not collide with the trailing end stopper, so that the sheet stays in the position and interferes with a leading end of the successive sheet. In this way, the sheet can not be appropriately discharged.

A first object of the present is to solve the above problems. That is, it is an object of the present invention to provide a sheet sorting apparatus characterized in that: the sheet finisher can be applied to a high speed image forming apparatus in which 90 to 100 copy sheets are printed in one minute; a large number of sheets are sorted and subjected to the after-processing such as stapling; and folding and occurrence of wrinkles are prevented, so that the sheets can be smoothly discharged.

When the following sheet discharge apparatus is used, the problems described later are caused. The detail of the sheet discharge apparatus will be described below. The sheet discharge apparatus includes: a first roller member made of elastic foaming material; and a second roller member, the diameter of which is smaller than that of the first roller member, wherein the pressure member is contacted with and separated from the second roller member. The pressure member comes into pressure contact with the outer diameter portion of the second roller member, so that a recording sheet is discharged onto the sheet discharge tray. After a trailing end of the recording sheet has been discharged, the recording sheet is slid on an inclined surface of the recording sheet discharge tray in a direction reverse to the sheet discharge direction by the weight of its own. Further, the trailing end of the sheet comes into pressure contact by the torque of the first roller member, so that the recording sheet can be contacted with a stationary stopper. In the above sheet discharge apparatus, when the trailing end of the sheet comes into contact with the stopper by the torque of the first roller member (sponge roller), even if the pushing forces of the plurality of sponge rollers are made to be uniform in the sheet width direction, amounts of deformation of the sponge rollers caused by compression are different from each other when the sponge rollers come into pressure contact with a stack of sheets of various sheet sizes. Due to the foregoing, in the case of sheets of small sizes, a pushing force given to the sponge roller coming into contact with the sheets is increased so that the sheet conveyance force is raised, and further an amount of deformation of the sponge roller is increased, so that the sheet comes into contact with the second roller member, so that the sheet curling force is increased. Therefore, various problems are caused, for example, the skew of sheets, the defective arrangement of sheet trailing ends, the wrinkles of sheets, and the occurrence of jam in which the sheet is carried beyond the stationary stopper and curled by the discharge roller.

When the stacked sheets on the discharge tray are gradually accumulated and the sheet discharge tray is controlled to be lowered so that the sheet discharge tray goes downward, and when the number of sheets is increased to not less than 1500, the stack of sheets is protruded upward, so that the trailing ends of sheets are difficult to be curled by the sponge roller. Accordingly, the trailng ends of sheets do not reach the stationary stopper. As a result, the trailing end of sheets can not be aligned.

When the height of stacked sheets on the sheet discharge tray is increased, an amount of deformation of the sponge roller with which the trailing ends of sheets collide is changed, so that the pushing pressure of the sponge roller is changed. Due to the change in the pushing conveyance force of the sponge roller, the trailing ends of sheets are not properly aligned. It is a second object of the present invention to solve the above problems. That is, an object of the present invention is to provide a sheet sorter having a high speed sheet after-processing apparatus, characterized in that the occurrence of folding or wrinkles can be prevented and the trailing ends of sheets can be stably and accurately aligned.

SUMMARY OF THE INVENTION

The first object of the present invention can be accomplished by the following sheet sorter. The sheet sorter comprises: a shift means for moving a sheet, which has been discharged along a conveyance path, by a pair of sheet discharge rollers in a direction perpendicular to the sheet discharge direction; and a discharge means for discharging a sheet onto a sheet discharge tray by holding the sheet, the discharge means being arranged in the downstream of the shift means in the sheet discharge direction, wherein the sheets can be sorted for each setting number by changing a position at which the sheets are discharged. The above discharge means includes: a rotatable lower sheet discharge roller by which the sheet can be discharged; a movable speed-reduction sheet discharge pushing member which comes into contact with and separates from the lower sheet discharge roller; a lower guide plate for moving a sheet conveyance face of the lower sheet discharge roller so that the sheet conveyance face can be embedded and exposed; an upper guide plate for guiding a conveyed sheet, the upper guide plate being arranged at a position above the lower sheet discharge roller; a drive means for driving the lower guide plate so that the lower guide plate can be moved, and a control means for controlling the drive means by a detection signal of a sheet passage detection sensor. In the case of normal conveyance of a sheet, under the condition that the drive means is turned off, the speed-reduction sheet discharge pushing member is withdrawn to a position above the upper guide member, and the lower guide plate is located at a stop position above the sheet contact face of the lower roller. Therefore, the conveyed sheet is discharged onto the sheet discharge tray without coming into contact with the speed-reduction sheet discharge pushing member and the lower sheet discharge roller. In the case of sorting sheets, after the completion of shifting a discharge sheet, the control means controls the drive means so that the speed-reduction discharge sheet pushing member can be contacted with the lower sheet discharge roller, and at the same time, the lower guide plate is moved to a position lower than the lower roller pressure contact position, so that the sheet can be discharged onto the discharge sheet tray.

The above object of the present invention can be accomplished by the following sheet sorter. The above discharge means includes: a rotatable lower sheet discharge roller by which the sheet can be discharged; a movable speed-reduction sheet discharge pushing member which comes into contact with and separates from the lower sheet discharge roller; a lower guide plate for moving a sheet conveyance face of the lower sheet discharge roller so that the sheet conveyance face can be embedded and exposed; an upper guide plate for guiding a conveyed sheet, the upper guide plate being arranged at a position above the lower sheet discharge roller; a drive means for driving the lower guide plate so that the lower guide plate can be moved; a drive source for driving the shift means; a sheet passage detection sensor arranged at a predetermined position in the conveyance path; and a control means for controlling the drive means by a detection signal of a sheet passage detection sensor and also for controlling the drive source. In the case of normally conveying a sheet, under the condition that the drive source is turned off, the drive means of the sheet discharge means is driven by the control of the control means in accordance with a sheet passage detection signal sent from the sheet passage detection sensor, so that the sheet conveyed in the conveyance path is discharged onto the sheet discharge tray through the shift means and the sheet discharge means. In the case of sorting sheets, the drive source of the shift means is controlled and driven by the control means in accordance with a sheet passage detection signal sent from the sheet passage detection sensor, and at the same time, the drive means of the discharge means is controlled, so that the speed-reduction discharge sheet pushing member and the lower guide plate are driven, and the shifted sheet is discharged onto the discharge sheet tray.

The above object of the present invention can be accomplished by the following sheet sorter. The above discharge means includes: a rotatable lower sheet discharge roller having a plurality of rollers, by which the sheet can be discharged; a speed-reduction discharge sheet pushing member composed of a plurality of pushing lever members which come into contact with and separate from the plurality of rollers of the lower sheet discharge roller and also composed of a support shaft for rotatably supporting the pushing lever member; a drive means for driving the speed-reduction discharge sheet pushing member; and a control means for controlling the drive means in accordance with a detection signal of the sheet passage detection sensor arranged at a predetermined position in the conveyance path. A plurality of pushing lever members of the speed-reduction discharge sheet pushing member are rotatably pivoted to the support shaft, and the pushing lever members are respectively pushed by springs, so that the plurality of pushing lever members uniformly come into pressure contact with the plurality of rollers of the lower roller.

The above object of the present invention can be accomplished by the following sheet sorter. The above discharge means includes: a rotatable lower sheet discharge roller having a plurality of rollers, by which the sheet can be discharged; a speed-reduction discharge sheet pushing member composed of a plurality of pushing lever members which come into contact with and separate from the plurality of rollers of the lower sheet discharge roller and also composed of a support shaft for rotatably supporting the pushing lever member; a drive means for driving the speed-reduction discharge sheet member; and a control means for controlling the drive means in accordance with a detection signal of the sheet passage detection sensor arranged at a predetermined position in the conveyance path. A sheet contact face of each pushing lever member of the speed-reduction sheet discharge pushing member includes: a pushing face which comes into pressure contact with the lower discharge roller so that the sheet speed can be reduced and the sheet can be discharged; a regulating face for dropping a trailing end of the discharge sheet onto the discharge tray side; and a guide face for guiding a trailing end of the sheet dropping by its own weight to a lower position of the lower sheet discharge roller.

The above object of the present invention can be accomplished by the following sheet sorter. The above discharge means includes: a rotatable lower sheet discharge roller having a plurality of rollers, by which the sheet can be discharged; a speed-reduction discharge sheet pushing member composed of a plurality of pushing lever members which come into contact with and separate from the plurality of rollers of the lower sheet discharge roller and also composed of a support shaft for rotatably supporting the pushing lever member; a drive means for driving the speed-reduction discharge sheet member; and a control means for controlling the drive means in accordance with a detection signal of the sheet passage detection sensor arranged at a predetermined position in the conveyance path. In this case, the drive means for making the speed-reduction discharge sheet pushing member to come into pressure contact with the lower sheet discharge roller is mounted on a rotatable support plate for supporting the speed-reduction sheet discharge pushing member.

The second object of the present invention can be accomplished by the following sheet sorter. In the sheet sorter, sheets of various sizes are discharged along a conveyance path. The discharged sheet is held and discharged by a discharge roller disposed in the downstream of the discharge direction and a pushing member which pushes the discharge roller. The discharged sheet is put on an inclination face of a discharge tray capable of being elevated, and a trailing end of the sheet collides with a stationary stopper so that the discharged sheet can be aligned in the sheet sorter. In this case, the sheet sorter is composed in the following manner. The discharge roller includes: a first roller member made of elastic foaming material; a second roller member made of hard rubber, the outer diameter of which is smaller than that of the first roller member; a flange portion by which the inner diameter portions of the first and second roller members are maintained on the same axis, wherein the outer diameter of the flange portion is larger than that of the second roller member and smaller than that of the first roller member; a drive shaft penetrating through the flange portion so that the drive shaft can be rotated integrally with the flange portion. The pushing member comes into pressure contact with the outer diameter portion of the second roller member, so that the sheet speed is reduced and the sheet is discharged onto the discharge tray. After the trailing end of the sheet has been discharged, the trailing end of the sheet comes into pressure contact by a torque of the first roller member, so that the trailing end is contacted with the stationary stopper and aligned. In this case, in the case of maximum pushing force, the sheet comes into contact with the flange portion and does not come into contact with the second roller member.

The above object of the present invention can be accomplished by the following sheet sorter. In the sheet sorter, the discharge roller includes: a first roller member made of elastic foaming material; a second roller member made of hard rubber, the outer diameter of which is smaller than that of the first roller member; a mandrel member by which the inner diameter portions of the first and second roller members are maintained on the same axis; a drive shaft penetrating through the mandrel member so that the drive shaft can be rotated integrally with the mandrel member. A shape of the pushing member on the sheet discharge side includes: a pushing portion which comes into pressure contact with the second roller member so that the speed of the sheet is reduced and the sheet is discharged; an intermediate portion adjacent to the pushing portion for pushing the trailing end of the discharged sheet to the discharge tray; and a fore end portion for guiding the trailing end of a sheet sliding down by its own weight, to the pressure contact portion of the first roller member when the discharged sheet slides down on the inclined stack surface of the discharge tray in a direction opposite to the sheet discharge direction, and when the trailing end of the sheet comes into pressure contact with the stationary stopper by the rotation of the first roller member.

The above object of the present invention can be accomplished by the following sheet sorter. In the sheet sorter, the discharge roller includes: a first roller member made of elastic foaming material; a second roller member made of hard rubber, the outer diameter of which is smaller than that of the first roller member; and a mandrel member by which the inner diameter portions of the first and second roller members are maintained on the same axis. In this case, the plurality of discharge rollers are arranged on the rotational shaft corresponding to the sheets of various sizes, and the discharge rollers are composed so that they can be rotated. The stationary stopper is arranged in such a manner that the stationary stopper is dispersed among the plurality of rollers so that the stationary stopper can include the widths of sheets of various sizes.

The above object of the present invention can be accomplished by the following sheet sorter. In the sheet sorter the discharge roller includes: a first roller member made of elastic foaming material; a second roller member, the outer diameter of which is smaller than that of the first roller member, wherein the pushing member comes into pressure contact with and is separated from the second roller member. The discharge roller, the pushing roller and the drive means for driving the pushing member are mounted on the sheet discharge unit. The sheet discharge unit is pushed by a spring member so that the first roller member can press the sheet on the discharge tray by a predetermined pressure.

BRIEF DESCRIPTION OF THE DRAWINGS

FIG. 8(A) is a front view and FIG. 8(B) is a sectional view taken on line D—D of the speed-reduction lever.

FIGS. 13(A) and 13(B) are sectional views showing a stack of sheets on the sheet discharge tray and a sponge roller member.

FIGS. 15(A) through 15(C) are sectional views showing a sheet discharge process when a large number of sheets are stacked on the sheet discharge tray.

FIGS. 16(A) through 16(C) are sectional views showing a successive sheet discharge process of the above sheet discharge process.

DETAILED DESCRIPTION OF THE PREFERRED EMBODIMENT

Next, with reference to the accompanying drawings, an example of the sheet after-processing apparatus having the sheet sorter of the present invention will be explained below.

Figure 1:
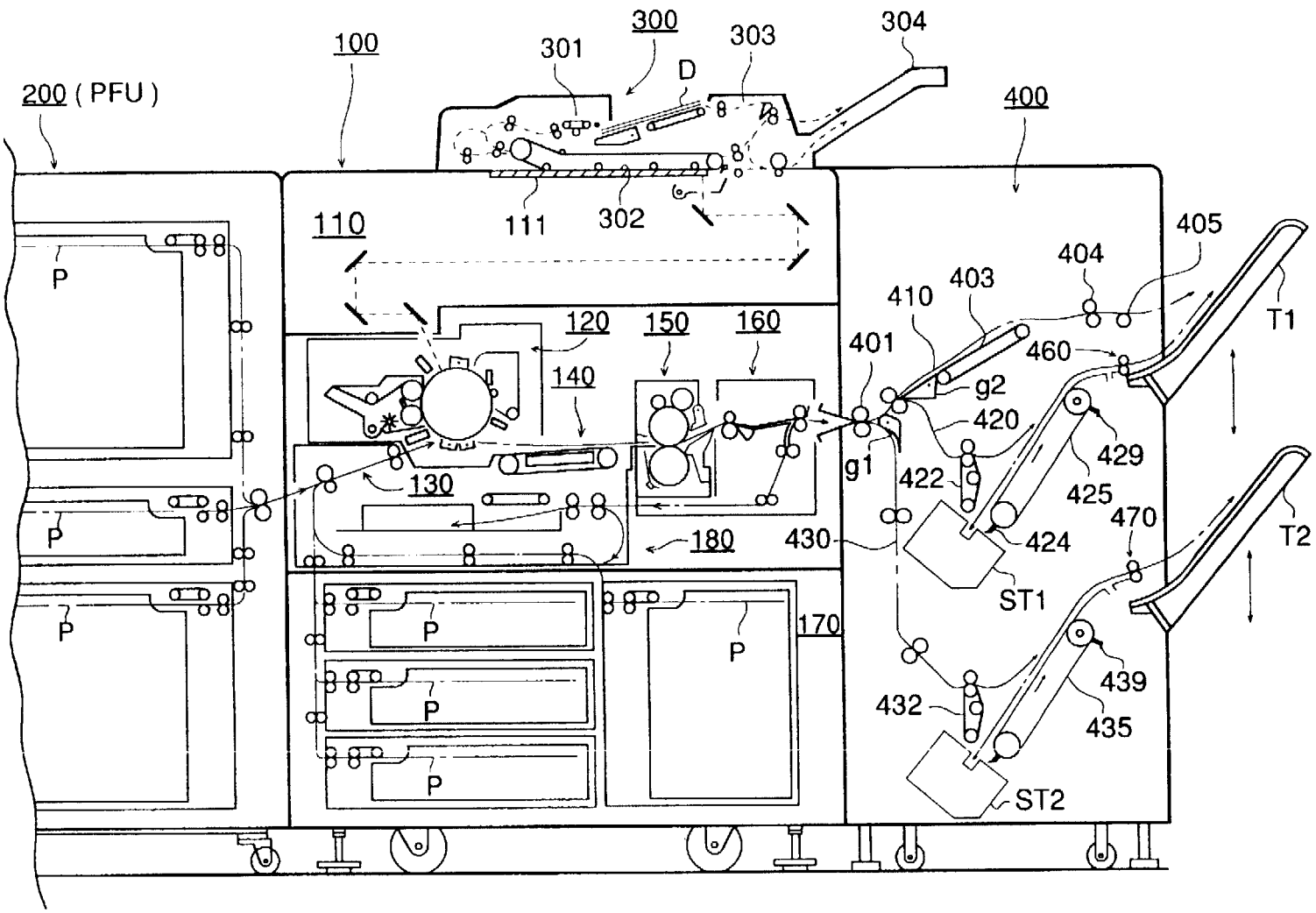
FIG. 1 is an overall arrangement view of the copier provided with the sheet after-processing apparatus of the present invention.

FIG. 1 is an overall arrangement view of the copier provided with a sheet after-processing apparatus. In FIG. 1, numeral 100 is a main body of the copier, numeral 200 is a sheet feed unit (PFU device), numeral 300 is a circulation type automatic document feeder (RDH device), numeral 400 is a sheet after-processing apparatus, which is a finisher. In this case, the sheet after-processing apparatus is referred to as an FNS apparatus hereinafter.

The copier 100 includes: a scanning and exposing section 110, an image forming section 120, a sheet feed section 140, a fixing section 150, a discharge sheet changeover section 160, a plurality of sheet feed cassettes 170, and an automatic duplex unit 180.

In the drawing, the one-dotted chain line represents a conveyance path of sheet P. Sheets P are accommodated in the sheet feed cassette 170 in the lower portion of the copier body 100, or alternatively sheets P are accommodated in the sheet feed unit (PFU unit) 200. An image is formed by the image forming section 120 on a sheet P sent out from the sheet feed cassette 170 or the sheet feed unit 200. Then the sheet P is accommodated in the FNS apparatus 400 via the conveyance section 140, fixing section 150 and discharge sheet changeover section 160. This route is referred to as a main route. On the other hand, sheet P that has branched from the discharge sheet changeover section 160 is temporarily stored in the ADU device 180, and then the sheet P is fed again and reaches the sheet feed section 130 of the copier body 100. This route is referred to as a circulation route.

When a copy button on the operation panel of the copier body 100 is pressed by an operator, feeding of a document D stacked on the document tray of the RDH unit 300 is started. The document D is conveyed onto a platen glass 111 by a conveyance belt 302 via the sheet feed section 301. In this way, the document D is placed at an exposure position.

By the action of the scanning and exposing section 110, a document image on the document D is subjected to exposure scanning so as to read the image. After the completion of reading, the conveyance belt 302 is rotated again so that the document is conveyed. Then the document passes through a reversal sheet discharge passage 303 and is accommodated on the lowermost layer of the document stack on the document tray.

Circulation sheet feeding operation of document D is described above. The RDH unit described above is also provided with the function of an automatic document feeder (ADF). In this case, after an image on the document D has been read, the document D advances straight and is discharged onto the discharge sheet tray 304 by the sheet discharge roller. In this way, the document sheets D are stacked onto the discharge sheet tray 304.

The image of document D, which has been obtained by exposure scanning, is subjected to the image processing in the copier body 100 and recorded on a sheet P fed from the sheet feed cassette 170 or the PFU unit 200.

After the image has been recorded on the sheet P, it is temporarily fed to the ADU unit 180. Then the sheet P is reversed, so that a sheet face on which the image is formed is set downward. Under this condition, the sheet P is discharged from the sheet discharge changeover section 160 and fed to the FNS unit 400 of the present invention.

Figure 2:
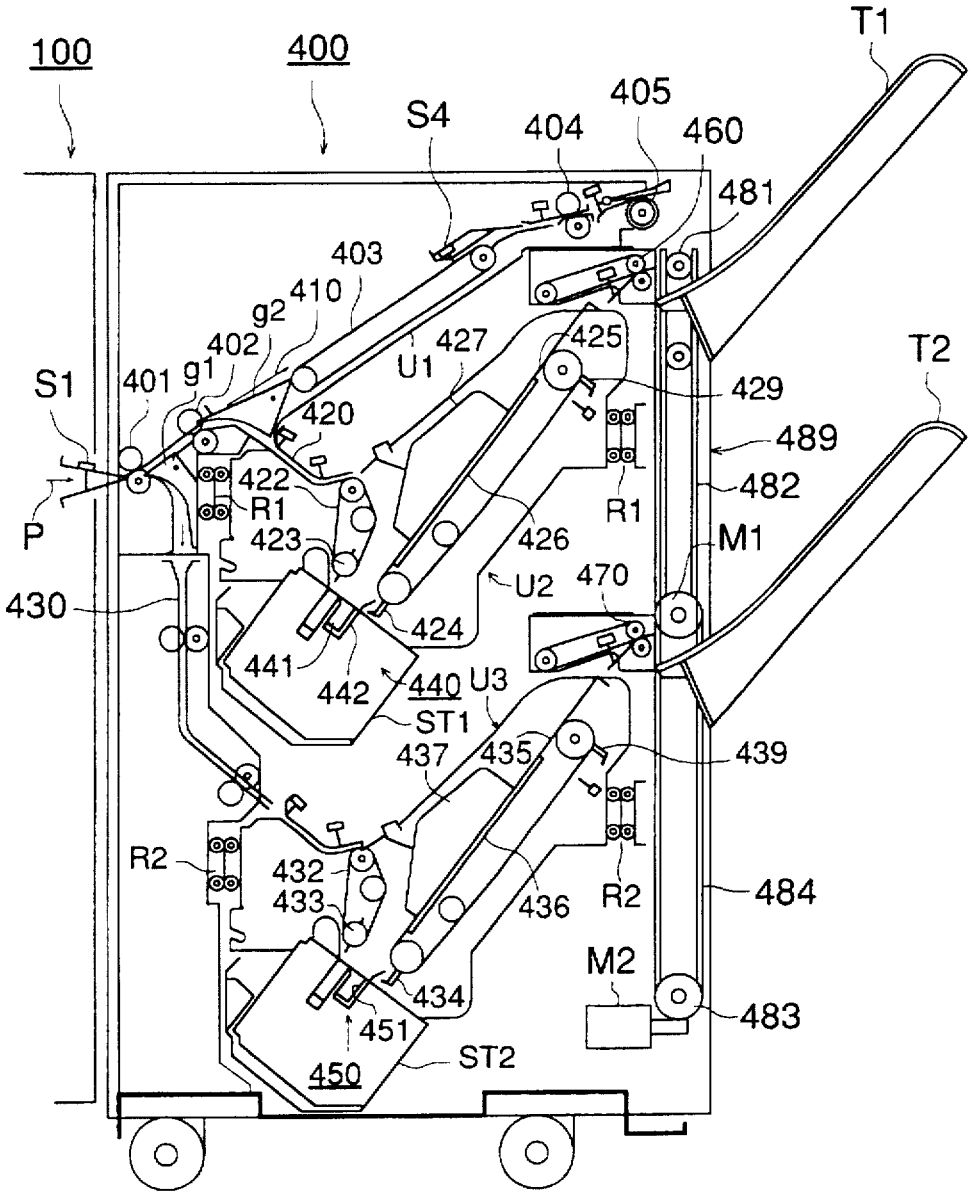
FIG. 2 is a sectional view of the sheet after-processing apparatus.

FIG. 2 is a sectional view showing an arrangement of the FNS unit 400. A receiving roller 401 of the FNS unit 400 receives a sheet P. The position and height of the receiving roller 401 of the FNS unit 400 are adjusted to those of the sheet discharge port of the copier body 100. The FNS unit 400 is connected to a control system so that the FNS unit 400 can be driven in accordance with the operation of the copier body 100.

A conveyance path of the sheet P connected with a rear portion of the receiving roller 401 branches into 3 systems including: an offset conveyance path 410 (first conveyance path) 410 in the upper stage, a second conveyance path 420 in the middle stage, and a third conveyance path 430 in the lower stage. When the tilting angles of the changeover gates g1, g2 are appropriately determined, the sheet P is fed to either conveyance path. In this case, U1 is a first unit composing the first conveyance path, U2 is a second unit composing the second conveyance path, and U3 is a third unit composing the third conveyance path.

The second and third conveyance paths 420, 430 are respectively provided with guide belts 422, 432 at the end portions on the downstream side of conveyance. By the actions of the guide belts 422, 432, a trailing end of the sheet P is conveyed into the stapler section. Discharge belts (timing belts) 425, 435 from which discharge claws 424, 434 are protruding are arranged at positions opposed to the guide belts 422, 432, and the first and second stackers 426, 436 are arranged being inclined by a predetermined angle in such a manner that each stacker interposes each discharge belt. Each of the guide belts 422, 432 is wound around 3 rollers. The lowermost roller is formed into a vane wheel 423, 433. Due to the foregoing structure, when the sheet P conducts a switchback motion, the sheet P can be positively contacted with the stoppers 441, 451 described later by the sliding actions of the vane wheels 423, 433.

There are provided a first stapler ST1 and a second stapler ST2 at the positions opposed to the lower ends of the first stacker 426 and the second stacker 436.

There is provided a first sheet discharge means 460 composed of a pair of sheet discharge rollers at a position close to the sheet discharge section of the FNS unit 400 on the downstream side of sheet conveyance of the first stacker 426. In the same manner as described above, there is provided a second sheet discharge means 470 on the downstream side of sheet conveyance of the second stacker 436.

Further, there is provided a discharge sheet tray elevating means 480 on the right of the FNS unit 400. In the discharge sheet tray elevating means 480, there are provided a pair of supporting members 482 which are moved upward and downward engaging with a pair of guide rollers 481. The first tray T1 and the second tray T2 are respectively held by the pair of supporting members 482, so that they can be independently moved upward and downward.

The staplers ST1, ST2, stackers 426, 436, and discharge belts 425, 435 are supported by the base plates of the pair of units U2 and U3. Therefore, they are attached to and detached from the FNS unit 400 through a pair of guide rails R1 and R2. Accordingly, when it is composed that the viewer's side of the apparatus can be opened, it is possible to remove the units such as the staplers, so that maintenance such as jam clearance can be easily conducted.

The pair of supporting members 482 are fixed to the elevating wires 484 provided between the exclusive motors M1, M2 and the pulley 483. When the motors M1 and M2 are rotated, the first sheet discharge tray T1 and the second sheet discharge tray T2 are respectively moved in the perpendicular direction in parallel with each other.

Figure 3:
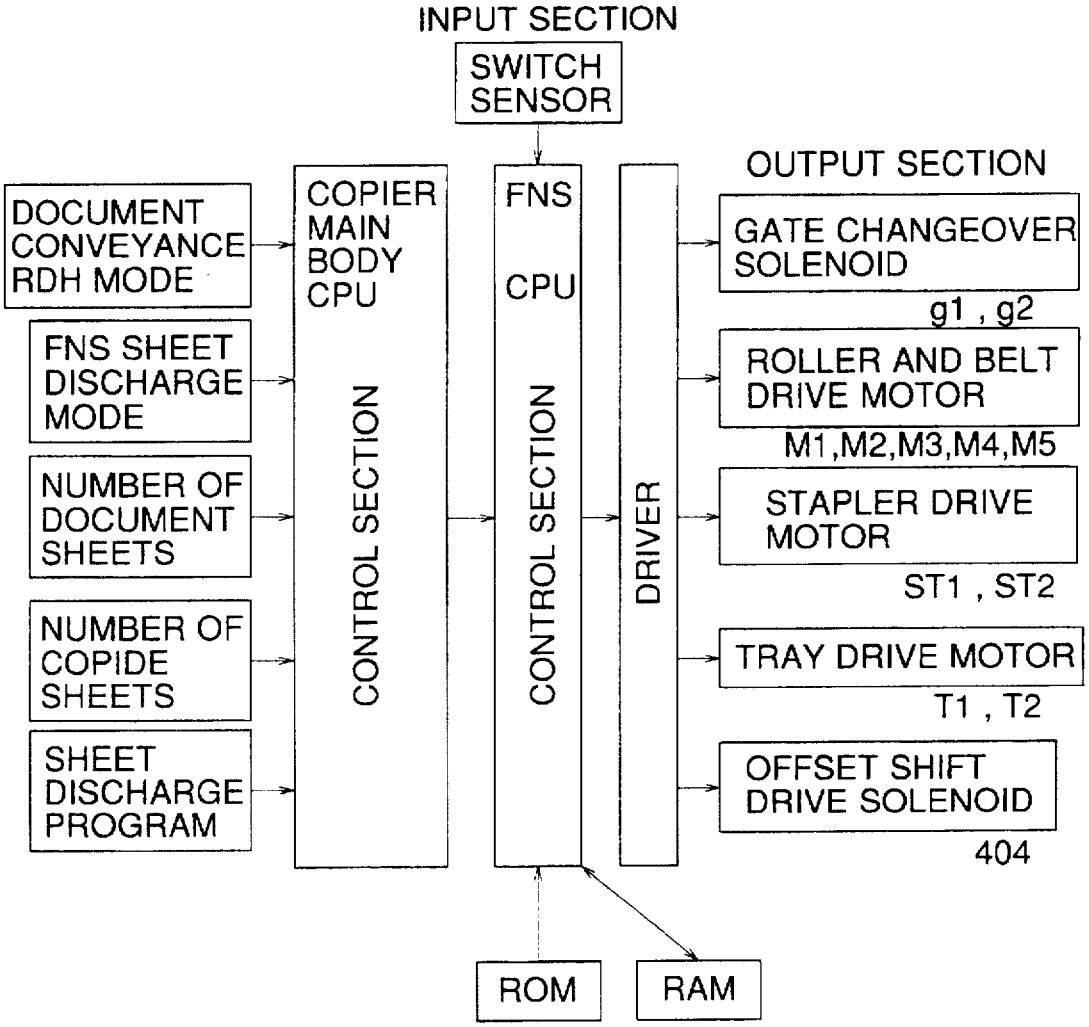
FIG. 3 is a block diagram showing the foundation of the control system.

The control circuit built in the copier body 100 and the FNS UNIT 400 is composed of a basic circuit shown in the block diagram of FIG. 3. Before the start of copying operation, the sheet discharge mode (staple mode or non-staple mode) is selected, and the numbers of documents and copy sheets are set.

When the non-staple mode is set, in which stapling is not required, the changeover gates g1, g2 are maintained in the initial condition, and the sheet P advances straight and passes through first conveyance path (offset conveyance path) 410 including the receiving roller 401, intermediate roller 402, conveyance belt 403 and discharge roller 405. Then the sheet P is discharged outside the apparatus and then stacked and accommodated on the first discharge sheet tray T1 in the upper stage.

When the offset mode is selected for the sheet discharge mode, the changeover gates g1, g2 are maintained in the initial condition, and the sheet P is fed upward to the first conveyance path 410. Then the sheet P is conveyed by the conveyance belt 403, a pair of offset rollers 404 and the discharge roller 405. After that, the sheet P is discharged onto the first sheet discharge tray T1. In this case, the pair of offset rollers 404 are composed of a drive and an idle roller. Further, the pair of offset rollers 404 are provided with an offset drive section by which the offset rollers 404 can be reciprocated in a direction perpendicular to the surface of the drawing. After a trailing end of the discharged sheet P has been detected (S4), the sheet P is shifted. Therefore, the discharged sheets can be stacked zigzag in the transverse direction for the number of copies.

When the staple mode is selected for the sheet discharge mode, the changeover gate g2 is rotated, and the sheet P received by the receiving roller 401 advances straight and is fed to the second conveyance path 420. Then the sheet P is temporarily pushed onto the first stacker 426 via the guide belt 422 in the second unit U2. At this time, the trailing end of the sheet P slides downward on the first stacker 426 by the rotation of the guide belt 422 and the weight of the sheet P. Accordingly, the sheet P is guided to a stapling section of the first stapler ST1, that is, the sheet P is guided to a stopper 441 of the sheet delivery section 440.

After the last sheet P of the first volume has been detected by sensor S1, the changeover gate g1 is rotated, and sheet P of the second volume is fed downward, so that the sheet P is fed to the third conveyance path 430. In the same manner as described above, the sheet P is pushed onto the second stacker 436 by the action of the guide belt 432. In this way, the stacking operation is started. In this connection, the sheet delivery section 450 of the third unit U3 is composed in the same manner as that of the sheet delivery section 440 of the second unit U2.

While the sheets P of the second volume are being fed, the sheets P of the first volume, the stacking operation of which has been completed, are stapled by the first stapler ST1. After that, by the returning motion of the delivery lever 442, the sheets are pushed up on the first stacker 426 to a predetermined position, resisting the gravity.

The first discharge belt 425 starts rotating when the motor is driven and the drive force is transmitted through the transmission means composed of gears and belts. In the period of time from the start of the first discharge belt 425 to the stoppage of the discharge claw 424 after it has pushed up the trailing end of the sheet P and rotated by one revolution, the first volume of sheets P, which have already been stapled, are discharged onto the first sheet discharge tray T1.

During this period, stacking of the sheets P of the second volume is completed, and the changeover gate g2 is returned to the initial position, and the second volume of sheets P, which have been stapled by the second stapler ST2, are discharged onto the second sheet discharge tray T2.

As described above, a plurality of volumes of sheets P, on which images have been formed, can be collated and stapled at the upper and lower positions at the same time. Accordingly, the after-processing of sheet P can be quickly carried out.

In accordance with the number of discharged sheets P, the motors H1 and M2 are operated. In accordance with the number of sheets to be processed, the first T1 and the second sheet discharge tray T2 are lowered, so that the sheets P can be discharged and stacked.

Figure 4:
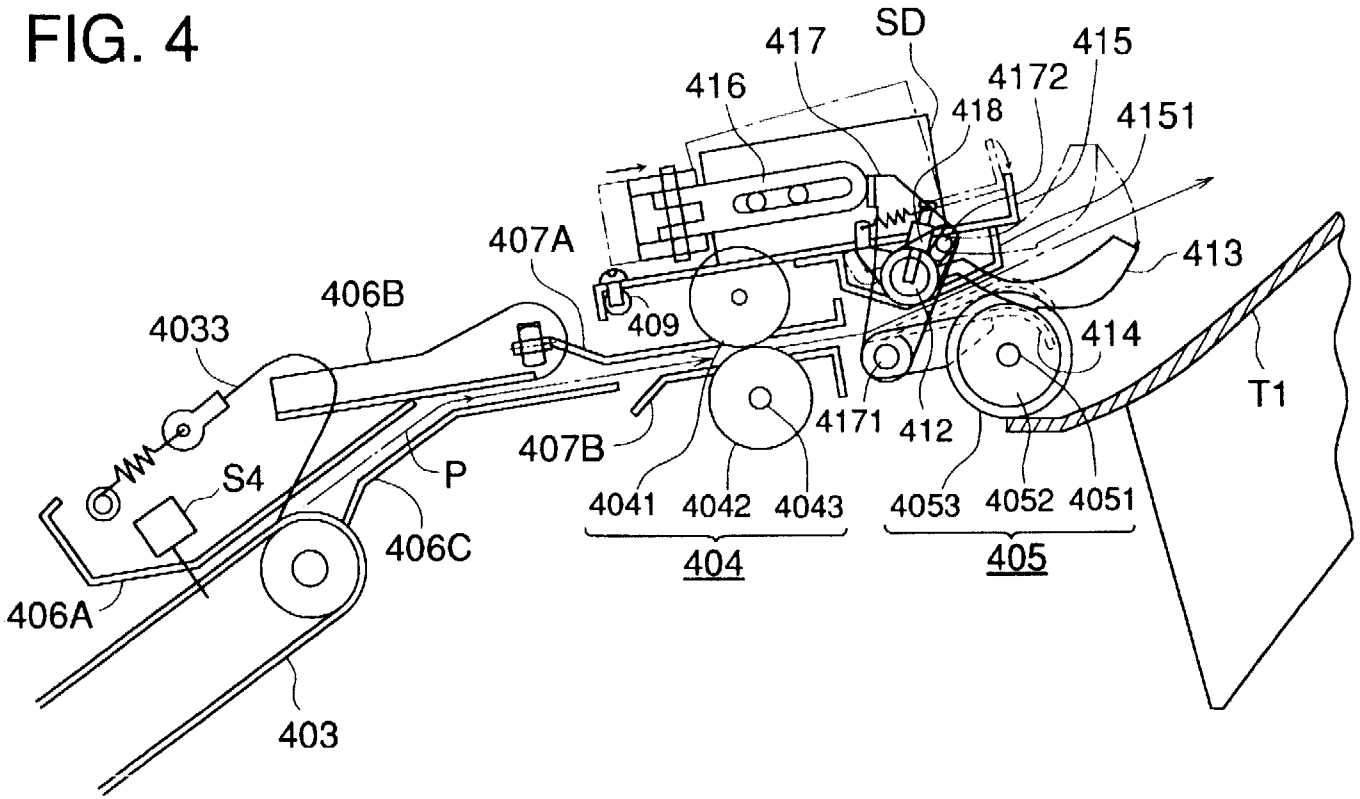
FIG. 4 is a sectional view of the portion close to the sheet discharge section of the offset conveyance path.
Figure 5:
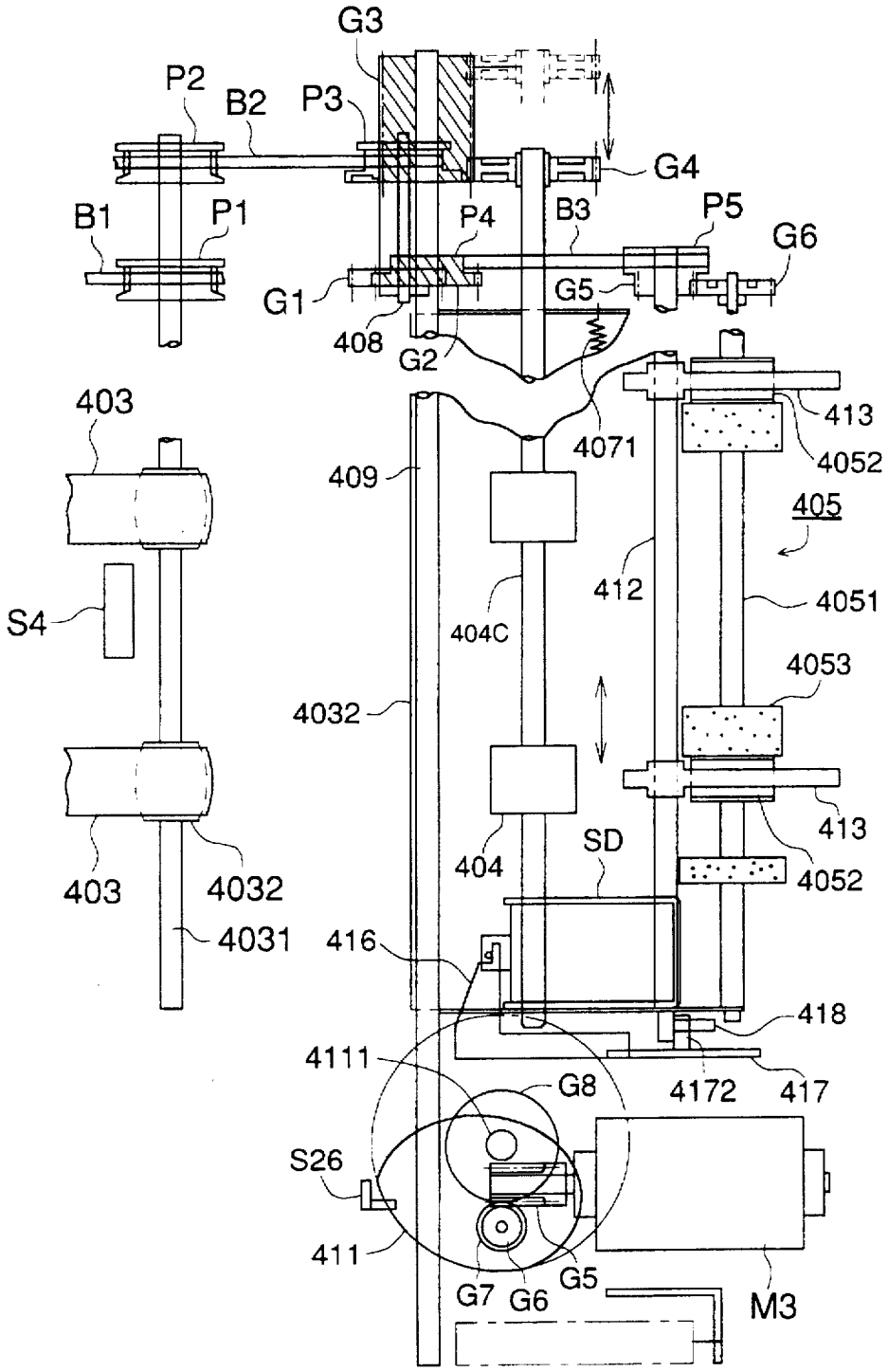
FIG. 5 is a plan view of the portion close to the sheet discharge unit.
Figure 6:
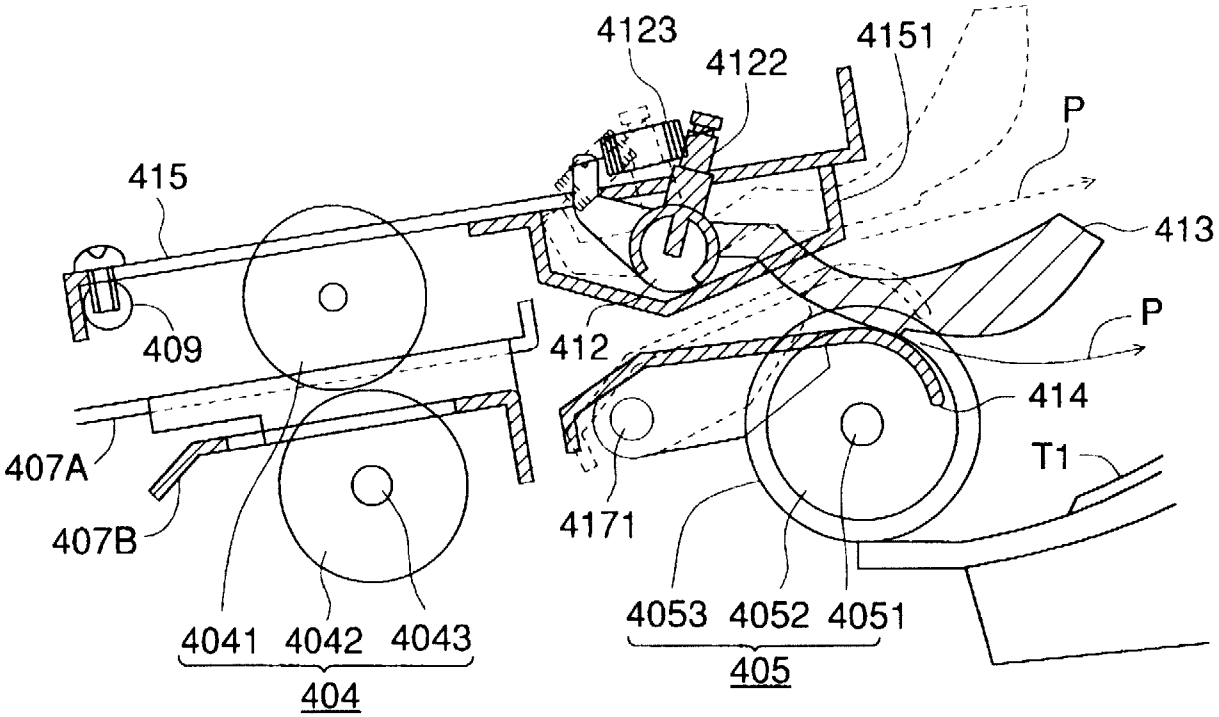
FIG. 6 is an enlarged sectional view of the primary portion close to the speed-reduction sheet discharge unit.

FIG. 4 is a cross-sectional view of a portion close to the sheet discharge section of the first conveyance path (offset conveyance path) 410. FIG. 5 is a plan view of the sheet discharge unit. FIG. 6 is an enlarged sectional view of a primary portion of the speed-reduction sheet discharge unit.

The sheet P is conveyed via the changeover gates g1, g2 in the conveyance path 410. Then the sheet P is conveyed upward being interposed between a plurality of parallel conveyance belts 403 and a plurality of stationary wires 4033, and then passes through a conveyance path formed between the upper guide plate 406A and the lower guide plate 406c. After that, the sheet P is conveyed to a pair of offset rollers 404. The conveyance belt 403 is wound and rotated around the drive roller 4032 attached to the drive shaft 4031. A toothed pulley P1 is attached to an end of the drive shaft 4031. In this case, the toothed pulley P1 is driven by a motor not shown via a toothed belt B1. In this connection, sensor S4 to detect the passage of a trailing end of a sheet is fixed to a portion on the upper guide plate 406A.

Another toothed pulley P2 is attached to the end of the drive shaft 4031. The toothed pulley P2 integrally rotates the intermediate shaft 408, toothed pulley P3 and gear G1 via the toothed belt B2. The gear G1 integrally rotates the gear G2 attached to an end of the oscillating shaft 409 and also rotates the toothed pulley P4. Gear G3 that is long in the axial direction is attached to the end of the oscillating shaft 409. Even when gear G4 attached to an end of the rotary shaft 4043 of the lower roller 4042 of the pair of offset rollers 404 is shifted in the axial direction (shown by the broken line in FIG. 5), gear G3 meshes with gear G4 at all times so as to transmit the rotation.

The pair of offset rollers 404 are a pair of rollers including the upper roller 4041 and the lower roller 4042, which can be rotated under the condition of pressure contact. The pair of offset rollers 404 are composed integrally with the movable upper and lower guide plates 407 (the upper guide plate 407A and the lower guide plate 407B). Therefore, the pair of offset rollers 404 can be reciprocated, that is, the pair of offset rollers 404 can be shifted in a direction perpendicular to the sheet conveyance direction. In other words, the roller shift motor M3 rotates the cam shaft 4111 and the cam 411 via the worm gear G5, worm G6, and gears G7, G8. The cam 411 comes into contact with a side wall of the lower movable guide plate 407B, and the lower movable guide plate 407B, the upper movable guide plate 407A and a pair of offset rollers 404 are moved in the axial direction (in the direction perpendicular to the surface of the drawing, that is, in the arrowed direction shown in FIG. 5). Numeral 4071 is a return spring to return the lower movable guide plate 407B. S26 is a sensor to detect the home position of the cam 411. In this connection, a shift guide section of the lower movable guide plate 407B is omitted in the drawing. In this connection, the cam 411 may be contacted with a roller rotatably supported by the lower movable guide plate 407B so that the lower movable guide plate 407B can be shifted.

Toothed pulley P4 attached to the oscillating shaft 409 rotates toothed pulley P5 via toothed belt B3, so that the oscillating shaft 412 to which gear G5 is attached can be oscillated. The oscillating shaft 412 rotatably supports a plurality of speed-reduction sheet discharge pushing members (speed-reduction levers) 413, for example 5 speed-reduction sheet discharge pushing members (speed-reduction levers) 413. Each speed-reduction levers 413 is pushed by a spring and uniformly comes into pressure contact with a circumferential surface of the rubber roller member 4052 of the discharge roller 405 described later.

Gear G5 is attached to the oscillating shaft 412 integrally with pulley P5. Gear G5 is meshed with gear G6 attached to an end of the rotary shaft 4051 of the discharge roller 405, so that the discharge roller 405 can be rotated.

Figure 7:
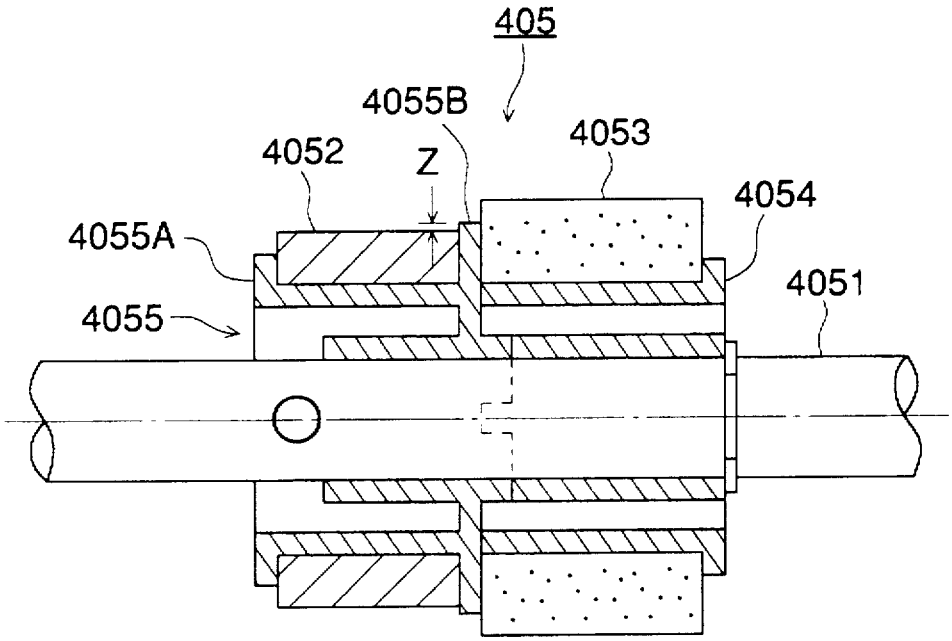
FIG. 7 is a partially enlarged sectional view of the discharge roller.

FIG. 7 is an enlarged sectional view showing a portion of the discharge roller 405. The discharge roller 405 includes: a rubber roller member (second roller member) 4052 coming into pressure contact with the speed-reduction lever 413; and a sponge roller member (first roller member) 4053, the diameter of which is a little larger than that of the rubber roller member 4052, wherein the sponge roller member 4053 is adjacent to the rubber roller member 4052. In this case, a plurality of rubber roller members 4052 and sponge roller members 4053 are arranged on the rotary shaft 4051.

The rubber roller member 4052 is made of synthetic rubber, the rubber hardness of which is approximately 60°, such as ethylene-propylene rubber (EPDM). The rubber roller member 4052 is integrally formed on a core member 4054 made of ABS resin. The above sponge roller member 4053 is a foaming sponge roller made of Everlightscot HR-40 manufactured by Bridgestone Co. In this case, sponge is integrally provided on the core member 4055 made of ABS resin. On the other hand, one core member 4054 and the other core member 4055 are joined to each other by the coupling structure of the prior art, and both core members are integrally mounted on the same axis as that of the rotary shaft 4051.

There is provided a flange portion 4055A at one end of the core member 4055. The outer diameter of the outer diameter portion 4055B of the flange portion 4055A is a little larger than that of the rubber roller member 4052, for example distance Z shown in FIG. 7 is approximately 0.2 mm When the sponge roller member 4053 comes into pressure contact with the uppermost layer of sheet stack P on the first sheet discharge tray T1 and is compressed, sheet P comes into contact with the outer diameter portion 4055B of the flange portion 4055A and also comes into contact with the outer circumferential surface of the compressed sponge roller member 4053, so that the uppermost layer of sheet stack P is not contacted with the outer diameter portion of the rubber roller member 4052. Accordingly, even when the sponge roller member 4053 is compressed at the maximum during the conveyance of sheet P, the rubber roller member 4052 is not contacted with sheet P at all times. Accordingly, sheet P is conveyed by the rotational conveyance force of the sponge roller member 4053, and a trailing end of sheet P collides with a stopper 419 described later.

After sheet P has passed through the discharge roller 405, it is conveyed in a sheet discharge passage formed between the upper guide plate 4151 and the lower oscillating guide plate 414. Then, sheet P is stacked on the first sheet discharge tray T1.

The upper guide plate 4151 is fixed onto the oscillating base plate 415. The oscillating base plate 415 is fixed to the oscillating shaft 409. Therefore, the oscillating base plate 415 can be oscillated around the oscillating shaft 409. An attraction type electromagnetic solenoid SD is fixed onto an upper face of the oscillating base plate 415. One end of the first lever 416 is engaged with the plunger of the electromagnetic solenoid SD. The other end of the first lever 416 comes into contact with the second lever 417 in such a manner that the second lever 417 can be oscillated. The second lever 417 can be oscillated around the shaft 4171. A pin 4172 is implanted in a portion of the second lever 417. The pin 4172 is engaged with a link plate 4121 fixed to an end of the oscillating shaft 412, so that the link plate 418 and the oscillating shaft 412 can be oscillated. An oscillating guide plate 414 is foxed to the shaft 4171. When the shaft 4171 is rotated, a fore end portion of the oscillating guide plate 414 goes up and down in the periphery of the circumferential surface of the discharge roller 405 on the sheet discharge passage side. Due to the forgoing, the circumferential surface of the sheet discharge roller 405 is exposed or shaded.

FIG. 8(A) is a front view of the speed-reduction lever 413. FIG. 8(B) is a sectional view taken on line D—D of the speed-reduction lever 413. In FIG. 6, a solid line represents a condition in which the speed-reduction lever 413 and the oscillating guide plate 414 are put into a speed-reduction sheet discharge condition, and a broken line represents an offset sheet discharge condition.

A plurality of studs 4122 are fixed to the oscillating shaft 412. A tension spring 4123 is provided between the top of each stud 4122 and the rear end of each speed-reduction lever 413. Therefore, the fore end portion of each speed-reduction lever 413 is pushed by the spring, so that the fore end portion of each speed-reduction lever 413 uniformly comes into pressure contact with the elastic roller 4052.

As shown in FIG. 8(A), the fore end portion of the speed-reduction lever 413 includes: a pushing section A coming into pressure contact with the sponge roller member 4053 so as to discharge sheet P at a reduced speed; an intermediate section B, which is a curved surface formed adjacent to the pushing section A, wherein the intermediate section B presses a trailing end of sheet P discharged from the discharge roller 405 against a sheet stacking surface of the first sheet discharge try T1; and a fore end section C, which is a fore end portion adjacent to the intermediate section B, wherein the fore end section C guides a trailing end of sheet P to the rubber roller member 4052 of the discharge roller 405 when the sheet P slides down on the first sheet discharge tray T1 after it has been discharged from the discharge roller 405.

As illustrated in FIG. 8(B), a portion close to the pushing section A of the speed-reduction lever 413 is protruded. Numeral 413D is a reinforcement portion for enhancing the mechanical strength, and numeral 413E is a flat pushing face, the width of which is 6 mm. Both sides of the pushing face 413E are formed into smooth curved faces (R: 1 mm). Width of the central flat portion of the speed-reduction lever 413 is 4 mm. Tension of the tension spring 4123 is set so that a pushing force on the pushing face per one lever can be 150 gf. In order to enhance the thick sheet discharging property, the pushing force of the speed-reduction lever 413 is set at a high value, however, due to the foregoing, the circumferential surface of the discharge roller 405 is prevented from being damaged by the speed-reduction lever 413.

In the process of speed-reduction sheet discharge, the fore end of the speed-reduction lever 413 is lowered and comes into pressure contact with the circumferential surface of the hard rubber roller member 4052. At the same time, the fore end of the oscillating guide plate 414 is also lowered and reaches approximately the same position as the circumferential face of the hard rubber roller member 4052, so that the fore end of the oscillating guide plate 414 comes into contact with the speed-reduction lever 413. In this condition, sheet P is held by the hard rubber roller member 4052, speed-reduction lever 413 and oscillating guide plate 414 ad discharged in the arrowed direction of a solid line.

In the offset sheet discharge condition, while the pair of offset rollers 404 and the movable guide plates 407A, 407B are being shifted, the speed-reduction lever 413 is raised and withdrawn to a position higher than the conveyance path of the stationary guide plate 4131. Therefore, the speed-reduction lever 413 is prevented from interfering with the conveyance path of sheet P shown by a broken line. At the same time, the oscillating guide plate 414 is also moved upward and shades the circumferential surface of the hard rubber roller member 4053. In this case, while the sheet P subjected to offset-discharge is not shaded by the speed-reduction lever 413 and the discharge roller 405, it is discharged through the conveyance path formed between the stationary guide plate 4131 and the oscillating guide plate 414 without causing any problems.

Figure 9:
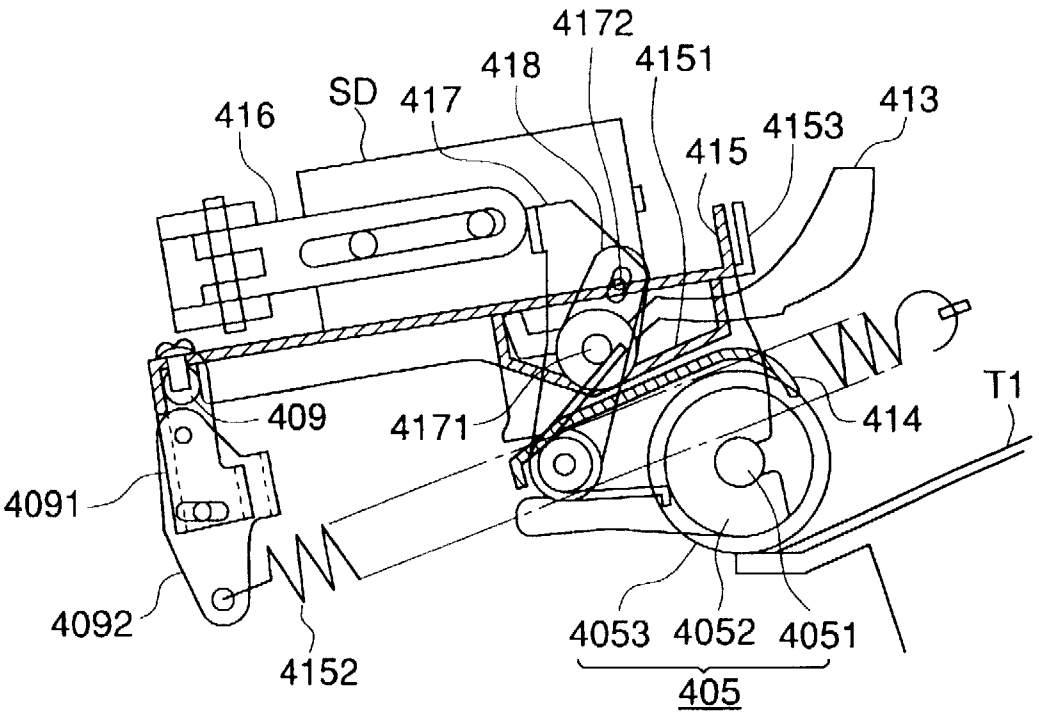
FIG. 9 is a sectional view of the speed-reduction sheet discharge unit showing a condition before a sheet is discharged.

FIG. 9 is a sectional view of the speed-reduction sheet discharge unit in a waiting condition before the discharge of a sheet. In this case, the plunger is protruded under the condition that the solenoid SD is not energized. Accordingly, the first lever 416 is stopped at the left position in the drawing, and the second lever 417 is pushed by the spring and contacted with the first lever 416. The pin 4172 of the second lever 417 rotates the link plate 418 counterclockwise, and the shaft 4171 integrated with the link plate 418 and the speed-reduction lever 413 are oscillated counterclockwise. Due to the foregoing, the fore end portion of the speed-reduction lever 413 is oscillated to a position higher than the upper cover 4151. Therefore, the fore end portion of the speed-reduction lever 413 is not contacted with an upper face of sheet P which is being discharged. At the same time, the oscillating guide plate 414 integrated with the second lever 417 is also oscillated counterclockwise and moved to a position higher than the discharge roller 405. Accordingly, the lower face of sheet P, which is being discharged, is not contacted with the discharge roller 405. In this connection, the oscillating base plate 415 on which the speed-reduction sheet discharge unit is mounted is pushed by the tension spring 4152 and oscillated clockwise around the oscillating shaft 409 and stopped at a predetermined position by a stopper not shown in the drawing. Numeral 4153 is an electrically discharging brush.

Figure 10:
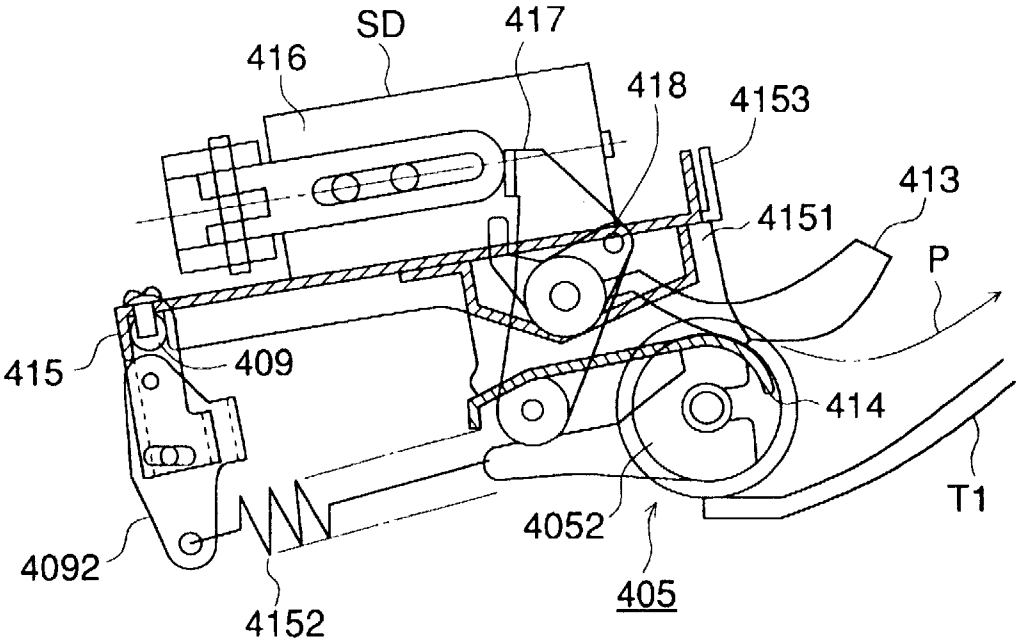
FIG. 10 is a sectional view showing a condition in which the speed-reduction sheet discharge unit discharges a sheet under the condition that the speed is reduced.

FIG. 10 is a sectional view showing a condition in which the speed-reduction sheet discharge unit discharges a sheet P at a reduced speed. By the attraction of the solenoid SD, the first and second levers 416, 417 are moved. As described above, the speed-reduction lever 413 comes into pressure contact with the circumferential surface of the rubber roller 4052 of the discharge roller 405. At the same time, the oscillating guide plate 414 is withdrawn to a position lower than the sheet discharge passage of the sheet discharge roller 405. In the above condition, while a trailing end of the sheet P is held by the discharge roller 405 and the speed-reduction lever 413, the sheet P is discharged to the first sheet discharge tray T1 at a reduced speed.

Figure 11:
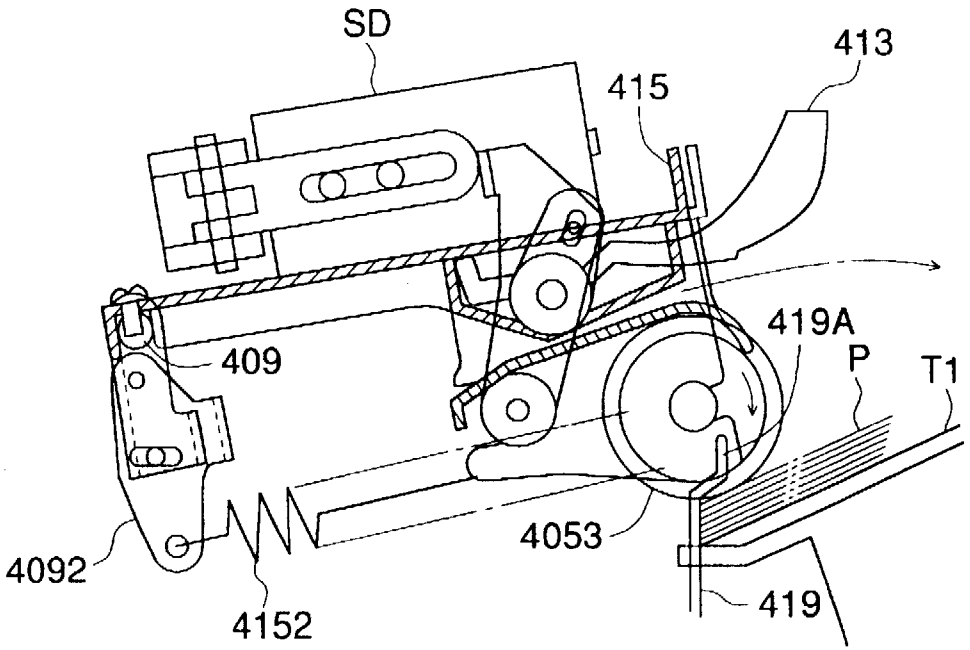
FIG. 11 is a sectional view of the speed-reduction sheet discharge unit showing a condition in which a large number of sheets are stacked on the sheet discharge tray.

FIG. 11 is a sectional view showing a condition in which the speed-reduction sheet discharge unit is raised in accordance with an increase in the number of sheets P stacked on the first sheet discharge tray T1. When sheets P are stacked on the first sheet discharge tray T1 , the trailing ends of sheets P collide with the stopper 419 by the torque of the sponge roller member 4053 of the discharge roller 405, and the thickness of the sheet stack is gradually increased. When the thickness of the sheet stack is increased, the discharge roller 405 is pushed upward, and the speed-reduction sheet discharge unit is oscillated counterclockwise around the oscillating shaft 409, resisting a pushing force of the tension spring 4152 described later, the change in the tension spring of which is small. Therefore, the stack of sheets on the sheet discharge tray are pressed and held by approximately the same pressure.

One end of the tension spring 4152 of the speed-reduction sheet discharge unit is engaged with an end of the regulating plate 4092 attached to the arm plate 4091 fixed to the end of the oscillating shaft 409. The other end of the tension spring 4152 is engaged with a portion of the frame of the sheet after-processing unit 400. When the speed-reduction sheet discharge unit is pushed clockwise by a predetermined tension, the sponge roller member 4053 is pushed to the first sheet discharge tray T1 side. The total pushing force of the plurality of sponge roller members 4053 (for example, 7 sponge roller members) arranged on the rotary shaft 4051 is set at 50 ±5 gf. When this pushing force is not more than 45 gf, a winding force of the sponge roller member 4053 to wind the trailing end of the sheet is weak so that the trailing end of the sheet does not reach the stopper 419. Especially when the first sheet discharge tray T1 is lowered, the trailing ends of sheets are not properly aligned. When the pushing force is not less than 55 g, a winding force of the sponge roller member 4053 to wind the trailing end of the sheet is too strong so that the trailing end of the sheet is excessively wound by the sponge roller member 4053 under the condition that the first sheet discharge tray T1 is raised, and the sheet gets over the stopper 419. Concerning the first sheet discharge tray T1, a position where the sensor is turned on by the stacked sheets P is different from a position where the first sheet discharge tray T1 , which is lowered after the sensor has been turned on is stopped. For example, the difference between the two points is set at 4 mm. A tension of the tension spring 4152 is set and adjusted by the regulating plate 4092 so that the pushing force of the sponge roller member 4053 can be in a range of 50 ±5 gf even when the first sheet discharge tray T1 is raise and lowered by the distance of 4 mm described above.

Figure 12:
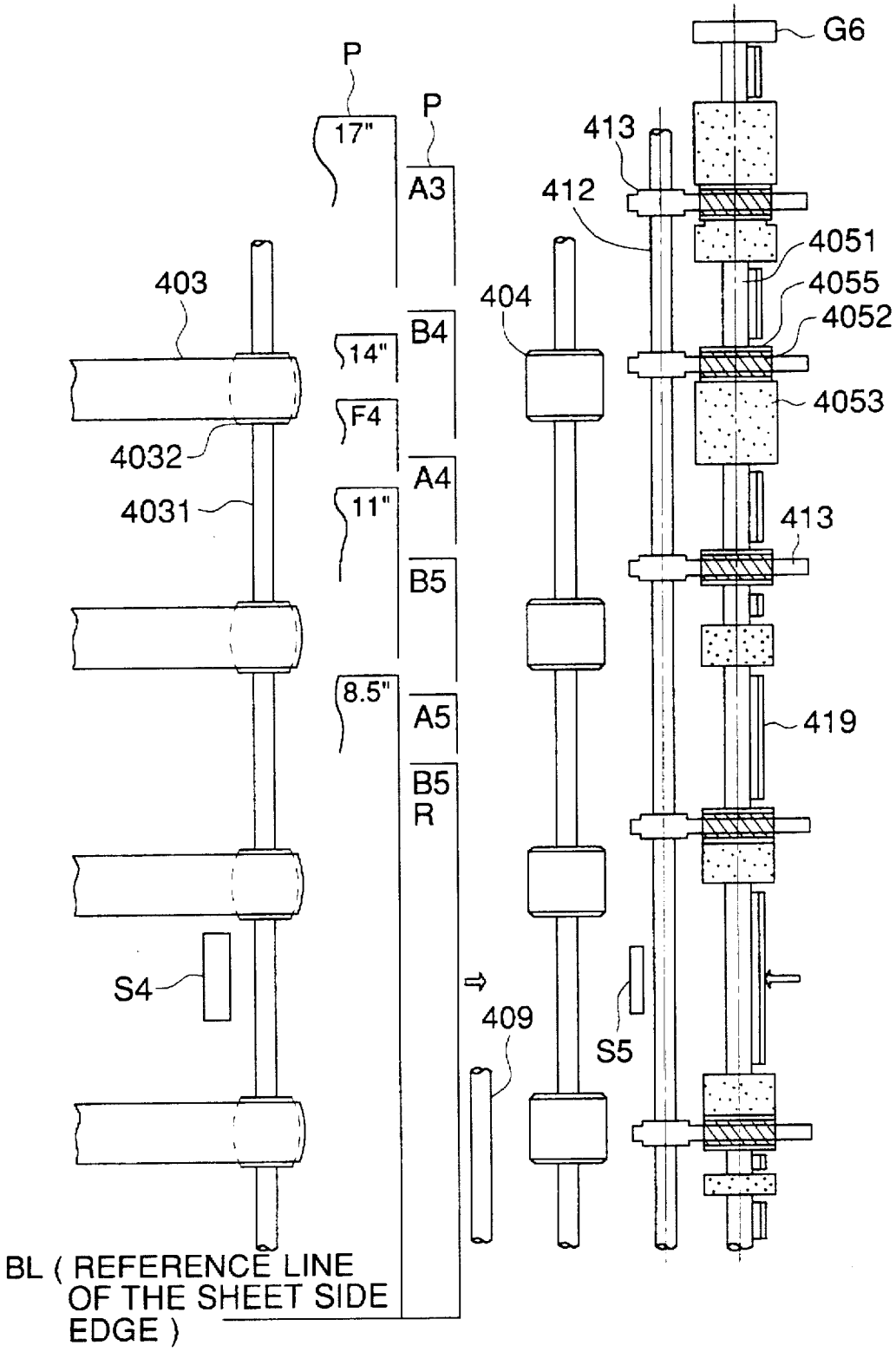
FIG. 12 is a plan view of the primary portion of the sheet sorter.

FIG. 12 is a plan view of the primary portion of the sheet sorter. The side of sheet P conveyed by the sorter advances along the sheet side reference line BL in the arrowed direction in FIG. 12. That is, a long side of the sheet P of each size is set in a direction perpendicular to the sheet conveyance direction, and the sheet P is conveyed while one side of the sheet P is set in accordance with the reference line. Then the sheet is conveyed by the conveyance belt 403, a pair of offset rollers 404, rubber roller member 4052, and speed reduction lever 413. The thus conveyed sheet P is discharged onto the first sheet discharge tray T1. After that, the trailing of the sheet P is conveyed by the sponge roller member 4053 in the reverse direction and comes into contact with the stopper 419 so as to be stopped. The stopper 419 is arranged at a lower position of the discharge roller 405 composed of a plurality of rollers. A plurality of sheet stopper faces are dispersed and arranged at positions different from the positions where the plurality of rollers are arranged. The fore end portion 419A of the stopper 419 is bent in such a manner that the trailing end of the stacked sheet is guided downward so that the trailing end of the sheet can not be carried beyond the stopper face and wound around the sponge roller member 4053. In this way, the trailing ends of the sheets stacked on the first sheet discharge tray T1 can be properly aligned.

FIG. 13 is a sectional view showing the shapes of the sponge roller member 4053 and the stack of sheets stacked on the first sheet discharge tray T1. FIG. 13(A) is a view showing a normal sheet end aligning condition. FIG. 13(B) is a view showing a condition in which the sponge roller member 4053 is compressed and elastically compressed by the sheet stack so that the sheets are contacted with the outer diameter portion 4055B of the flange portion 4055A. In this contact condition, an amount of elastic deformation of the sponge roller member 4053 is maximum. Therefore, further deformation is restricted. Even if the sponge roller member 4053 is deformed, the sheet P is prevented from coming into contact with the rubber roller member 4052 by the outer diameter portion 4055B of the flange portion 4055A.

Figure 14:
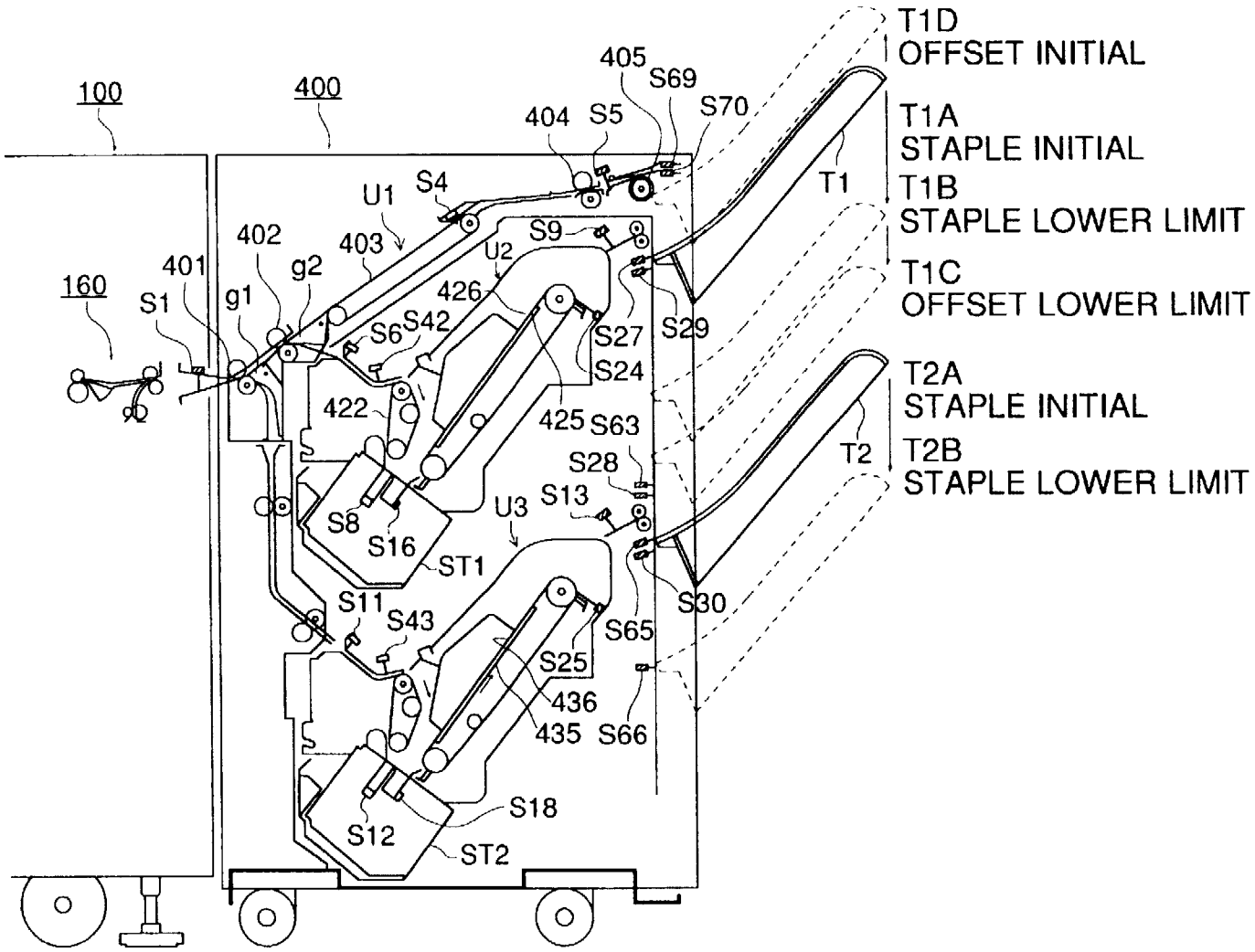
FIG. 14 is an arrangement view showing a sensor arrangement of the sheet after-processing apparatus of the present invention and also showing a movement of the sheet discharge tray.

FIG. 14 is an overall arrangement view showing the sensor arrangement and the discharge tray movement of the sheet after-processing unit 400 of the present invention.

There is provided a sheet passage detection sensor S1 at a position close to the sheet entrance opening of the FNS unit 400. When the sheet P has passed through the sensor S1, it is detected that the sheet P is sent into the FNS unit 400. There is provided a sheet trailing end passage detection sensor S4 in the upstream of the discharge roller 405 in the offset conveyance path 410. In the case of offset mode sheet conveyance, when the passage of the trailing end of the sheet is detected, the discharge roller 405 is shifted in a direction perpendicular to the surface of the drawing. Further, there is provided a sheet discharge sensor S5 in the downstream of the discharge roller 405, and the passage of the sheet is detected by the sheet discharge sensor S5.

There are provided sheet passage detection sensors S6 and S42 in the upstream of the conveyance roller 421 in the second conveyance path 420 located at a position under the offset conveyance path 410. These sensors S6 and S42 detect the passage of the sheet P. Sensor S8 detects that no sheets are provided on the first stacker 426 in the upper stage. S16 is a sensor to detect the sheet holding position of the sheet delivery section in the upper stage. S24 is a home position sensor of the discharge belt 425. S9 is a sheet discharge sensor.

In the same manner, in the third sheet conveyance path 430, there are provided sheet passage sensors S11, S43, no-sheet detection sensor S12, sheet holding position detection sensor S18, and sheet discharge sensor S13.

Next, in the elevation drive section of the sheet discharge trays T1 and T2, there are provided an offset upper stage detection sensor S69 and an offset sheet drawing detection sensor S70 at positions close to the discharge port of the offset conveyance path in the uppermost stage. At positions close to the discharge port of the second conveyance path 420 in the middle stage and at positions under the above positions, there are provided a tray upper limit detection sensor S27 to control the elevation of the first sheet discharge tray T1, a tray sheet drawing detection sensor S29, a tray collision detection sensor S63, and a tray lower position detection sensor S28. At positions close to the discharge port of the third conveyance path 430 in the lower stage, there are provided a tray upper position detection sensor S65 to control the elevation of the second sheet discharge tray T2 and a tray sheet drawing detection sensor S30. In the lowermost stage, there is provided a tray lower limit position detection sensor S66 to control the descending of the second sheet discharge tray T2.

In FIG. 14, T1 A represents an initializing position of the first sheet discharge tray T1 in the case of stapling operation, T1B represents a lower limit position in the case of stapling operation when 1500 sheets are stacked at the maximum, TiC represents an offset lower limit position when 2000 sheets are stacked at the maximum, and T1D represents an offset initializing position.

Concerning the elevating positions of the second sheet discharge tray T2 in the lower stage, T2A represents an initializing position in the case of stapling operation, and T2B represents a withdrawal lower limit position of the second sheet discharge tray 2 when 2000 sheets are stacked on the first sheet discharge tray T1 at the maximum. At the lower limit position T2B of the second sheet discharge tray T2, the first stacker 426 and the second stacker 436 are prohibited from discharging sheets.

When not less than 1500 sheets P are accumulated on the first sheet discharge tray T1, the sheet stack is curved and formed to be concave with respect to the upper direction. Therefore, it is difficult to wind and convey the sheets by the sponge roller member 4053, so that the trailing ends of sheets can not be aligned properly.

FIGS. 15 and 16 are sectional views showing the sheet discharge process when a large number of sheets (for example, not less than 1500 sheets) are stacked on the first sheet discharge tray T1 of the present invention.

FIG. 15(A) is a view showing a condition in which the sheet P is discharged onto a sheet stack provided in the first sheet discharge tray T1 by a pair of offset rollers 404 not shown in the drawing. At this time, as illustrated in FIG. 9, the speed-reduction lever 413 and the oscillating guide plate 414 are located at the elevating positions, so that the discharge of the sheet P is not blocked.

FIG. 15(B) is a view showing a condition in which the discharging motion of the sheet P advances, and the trailing end of the sheet P is held by the speed-reduction lever 413 and the roller member 4052 so that the sheet P is discharged at a reduced speed and slides on the sheet stack. At this time, the oscillating guide plate 414 is withdrawn to a position lower than the holding position.

FIG. 15(C) is a view showing a condition in which the trailing end of the sheet P further advances from the holding position and is discharged at a reduced speed. At this time, the trailing end of the sheet P is prevented from jumping up by the fore end C (in FIG. 8(A)) of the speed-reduction lever 413.

FIG. 16(A) is a view showing a condition in which the sheet P is moved on the tilted sheet stack by the weight of the sheet itself in a direction opposite to the sheet discharging direction, and the trailing end of the sheet P advances toward the speed-reduction lever 413. At this time, the trailing end of the sheet P is guided to the first sheet discharge tray T1 by the fore end C (in FIG. 8(A)) of the speed-reduction lever 413 and the intermediate portion B (in FIG. 8(A)).

FIG. 16(B) is a view showing a condition in which the sheet P is further moved in the opposite direction by its own weight, and the trailing end of the sheet P comes into pressure contact with the sponge roller member 4053. The trailing end of the sheet P is successively moved downward by a frictional conveyance force generated on the circumferential face of the sponge roller member 4053.

FIG. 16(C) is a view showing a condition in which the trailing end of the sheet P is lowered and sent into the holding position between the sponge roller member 4053 and the uppermost layer of the sheet stack by the pushing force of the sponge roller member 4053, that is, by the pushing force of the speed-reduction sheet discharge unit generated by the tension spring 4152. After that the speed-reduction lever 413 and the oscillating guide plate 414 are moved upward and stopped at the initial positions.

As described above, even if the sheet stack is curved to be concave with respect to the upper direction when the number of sheets stacked on the first sheet discharge tray T1 is increased to not less than 1500, the trailing end of the sheet P accurately comes into contact with the stopper 419 by the actions of the speed-reduction lever 413 and the sponge roller member 4053. Therefore, the trailing end of the sheet P is not carried beyond the stopper 419, so that the occurrence of jam is avoided, and the sheet ends are properly aligned.

According to the present invention, the occurrence of various problems can be prevented such as the skew of sheets discharged from the sheet sorter onto the sheet discharge tray, the defective alignment of trailing ends of sheets, and the occurrence of wrinkles and jam. Therefore, sheets can be stably discharged and stacked on the sheet discharge tray with high accuracy.

Figure 17:
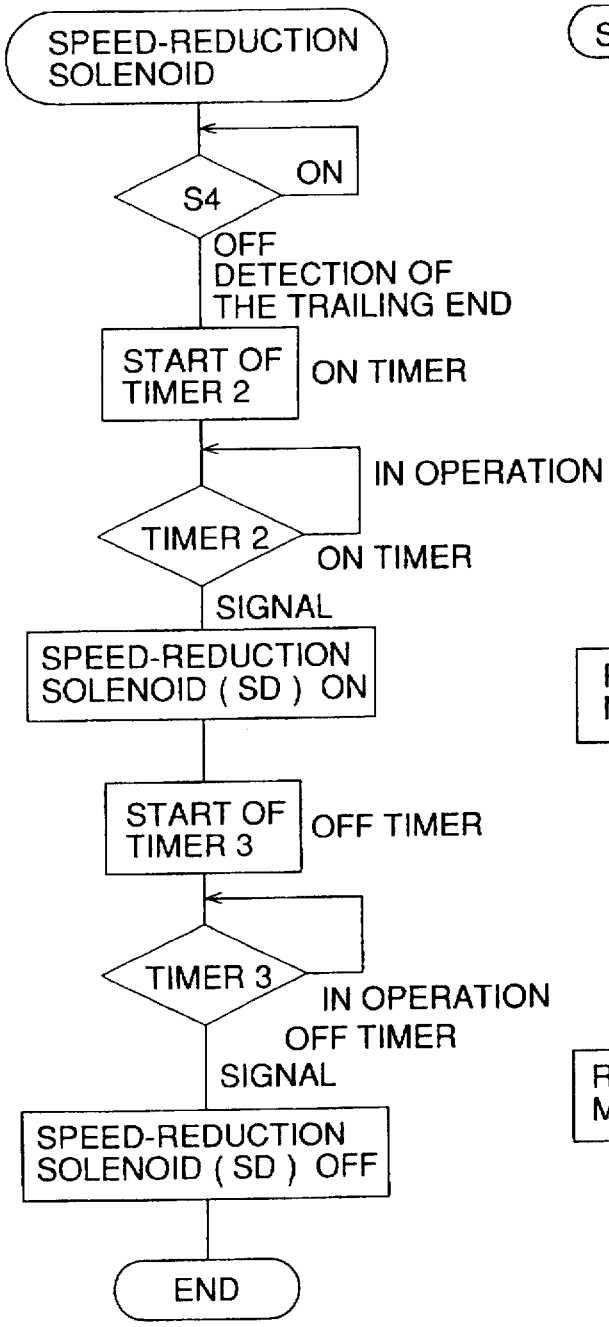
FIGS. 17(A) and 17(B) are flow charts showing the speed-reduction sheet discharge motion conducted by the sheet sorter of the present invention.
Figure 17:
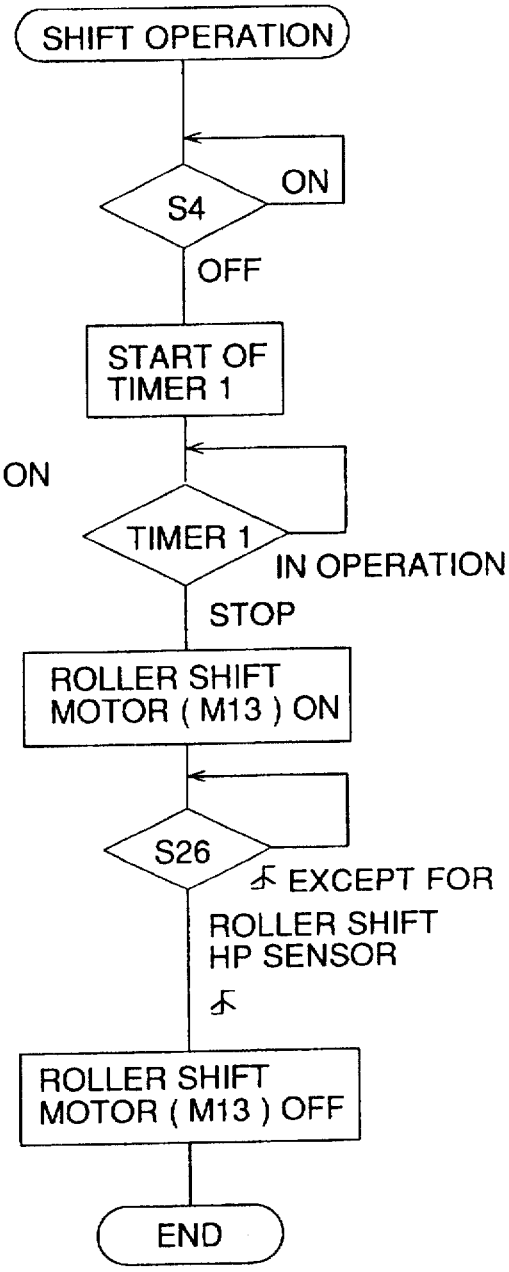
Figure 18:
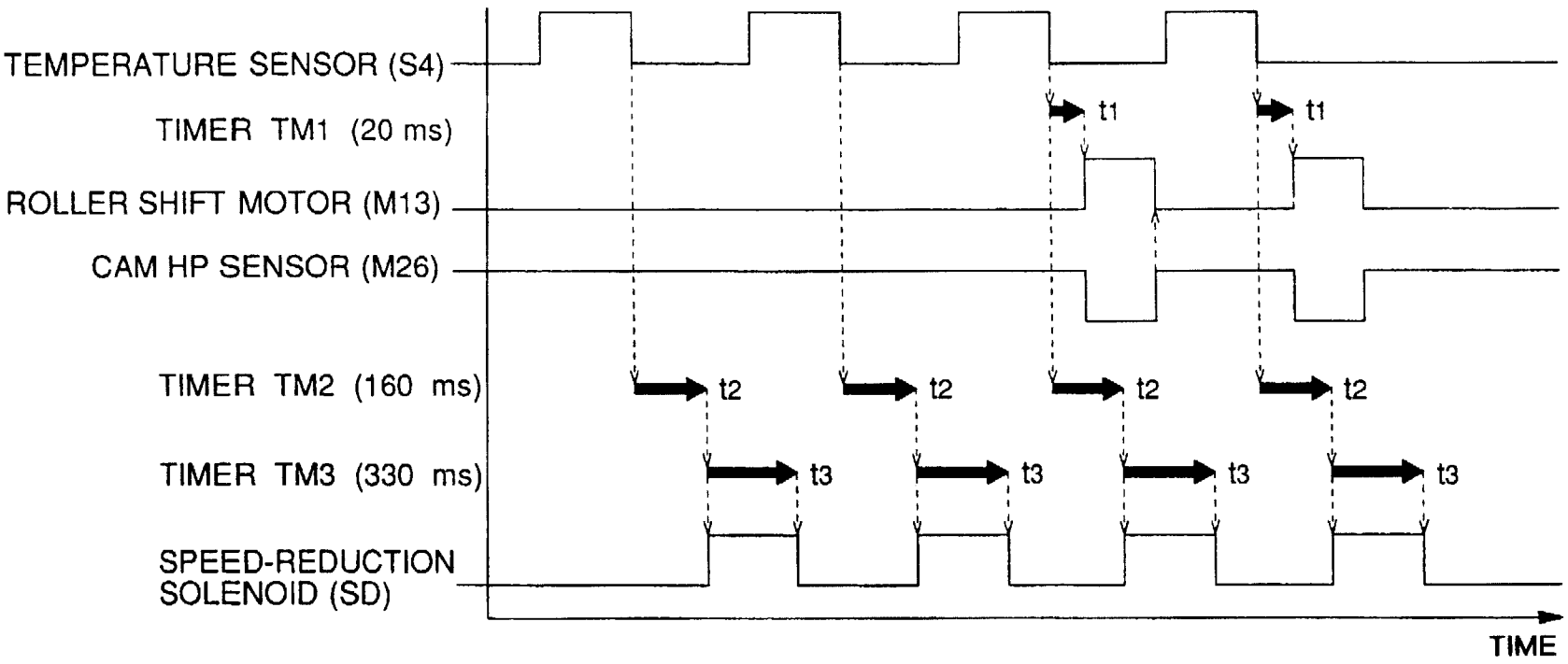
FIG. 18 is a time chart in the case of sheet discharge in which the speed is reduced.

FIGS. 17(A) and 17(B) are flow charts showing the speed-reduction sheet discharging motion conducted by the sheet sorter of the present invention. FIG. 17(A) is a view showing the speed-reduction sheet discharging motion, and FIG. 17(B) is a view showing the shifting motion. FIG. 18 is a time chart showing the motion in which sheets are discharged two by two at a reduced speed.

In this case, there is provided a passage detection sensor S4 at the outlet of the conveyance path of the conveyance belt 403. When the passage detection sensor S4 detects the passage of the trailing end of the first sheet P, the timer TM2 (ON-timer) starts and turns on the solenoid SD after a predetermined period of time t2 (for example, 160 ms). At the same time, the timer TM3 (OFF-timer) starts and turns off the solenoid SD after a predetermined period of time t3 (for example, 330 ms). During the operation of the solenoid SD, the sheet is discharged at a reduced speed as illustrated in FIG. 10, and the discharged sheet is stacked on the sheet discharge tray T1. In the same manner as described above, the second sheet P is discharged at a reduced speed and stacked on the sheet discharge tray T1.

In order to shift and discharge the third and the fourth sheet, the operation is conducted as follows. When the passage detection sensor S4 detects the passage of the trailing end of the third sheet, the timer TM1 starts and drives the roller shift motor M3 after a predetermined period of time t1 (for example, 20 ms) has passed. When the motor M3 is driven, the cam 411 is rotated. When the cam position sensor S26 detects the passage of a predetermined portion of the cam 411, a detection signal is sent out from the cam position sensor S26. The motor M3 is stopped by this detection signal. By the rotation of the cam 411, the pair of offset rollers 404 and the movable guide plates 407A, 407B are linearly moved by predetermined distances in the axial direction which is perpendicular to the sheet-discharging direction, so that the sheet P is shifted. During this shifting operation, as illustrated in FIG. 9, the speed-reduction sheet discharge unit allows the end of sheet P to pass through under the condition that the discharge roller 405 and the speed-reduction lever 413 are separate.

On the other hand, after the trailing end has been detected by the passage detection sensor S4, the solenoid SD is turned on after the predetermined period of time t2 has passed. Further, after the predetermined period of time t3 has passed, the solenoid SD is turned off, and in the same manner as described above, the speed-reduction lever 413 is made to come into pressure contact with the discharge roller 405 so that the sheet P is discharged at a reduced speed. In this case, the solenoid SD may be driven after the completion of the offset motion, or alternatively the solenoid SD may be driven immediately before the completion of the offset motion.

According to the present invention, it is possible to provide a sheet sorter characterized in that: the defective sheet discharge and sheet damage can be prevented which occur when the end of a sheet conveyed by a pair of shift rollers collides with a circumferential surface of the sheet discharge roller and also collides with the pushing members such as a lever and roller which come into pressure contact with and separate from the sheet discharge rollers.

Since the plurality of pushing members described above come into pressure contact with the discharge rollers with a uniform pressure, the occurrence of wrinkles can be prevented.

Since the solenoids to drive the pushing members and guide members of the speed-reduction unit are mounted on the base plate of the unit, it is possible that the discharge roller comes into pressure contact with the pushing members at a constant stroke irrespective of the thickness of the stack of sheets on the sheet discharge tray. Accordingly, the dimensions and capacity of the solenoid can be reduced, and further it is advantageous that the assembly is easy since the apparatus is composed of the units.

When both side members coming into pressure contact with the discharge roller are smoothly chamfered, even if the pushing force of the pushing member is set at a high value, there is no possibility that the discharge roller is damaged. Therefore, the sheet discharging property can be enhanced when thick sheets of paper are discharged.

What is claimed is:

1. An apparatus for sorting sheets on a tray, comprising:

a shift device to shift a sheet held on a pair of rollers in a direction perpendicular to a sheet discharging direction toward the tray so that a stacking position of sheets is changed for each set number of sheets to one of different stacking positions on the tray;

a discharging device positioned between the shift device and the tray and discharging the shifted sheet to one of the different stacking positions, the discharging device including a rotatable discharging roller to discharge the sheet;

a pressing member movable between a low position, wherein said pressing member contacts said discharging roller and reduces a discharging speed of said sheet, and a high position, wherein said pressing member is separated from said discharging roller;

a lower guide plate movable between a first position, wherein said lower guide plate is above said discharging roller, and a second position, wherein said discharging roller is lower than an upper portion of said discharging roller;

a sensor to detect a passage of a sheet;

a driving device to move the lower guide plate and the pressing member in response to a signal from the sensor.

2. The apparatus of claim 1, wherein the discharging roller is an elastic roller.

3. The apparatus of claim 1, wherein the sensor is a photosensor to detect a passage of a trailing edge of the sheet.

4. The apparatus of claim 3 wherein the pressing member is a pressing lever which is biased by a spring member toward said discharging roller and comes into slidable contact with said discharging roller.

5. The apparatus of claim 4, wherein the pressing lever member is supported by a shaft and is pivotal around the shaft.

6. The apparatus of claim 4, wherein the pressing lever includes a pressing surface which comes in contact with the discharging roller and reduces the discharging speed of the sheet, a regulating surface to regulate the trailing edge of the sheet so as to drop the sheet into the tray, and a guiding surface to guide the trailing edge of the sheet dropping by its weight along the tray toward to a lower side of the discharging roller.

7. The apparatus of claim 4, wherein the discharging device comprises a plurality of the discharging rollers and a plurality of the pressing levers.

8. The apparatus of claim 4 wherein said pressing lever has a pressing surface which has two side edges, said edges being curved.

9. The apparatus of claim 1, wherein the discharging device comprises a pivotable supporting base on which the pressing member and the driving device are mounted.

10. The apparatus of claim 1, wherein the discharging roller comprises a first roller made of a formed elastic material, a second roller made of a hard rubber, and a diameter portion, and wherein the outer diameter of the first roller is larger than that of the diameter portion, the outer diameter of the second roller is smaller than that of the diameter portion, and the first roller, the second roller and the diameter portion are coaxially mounted on a driving shaft in a form of one body.

11. The apparatus of claim 10, wherein the pressing member comes in contact with the second roller so as to reduce the discharging speed of the sheet.

12. The apparatus of claim 10, wherein the tray is so inclined that the discharged sheet is dropped along the tray by its weight, and wherein the first roller comes in pressure contact with the trailing edge of the dropped sheet and moves the sheet until the trailing edge of the sheet comes in contact with a stopper so that trailing edges of the discharged sheets are aligned.

13. The apparatus of claim 12, wherein the discharging device comprises a plurality of the discharging rollers and a plurality of the stoppers so as to handle a plurality of sheet sizes.

14. The apparatus of claim 10, wherein when the first roller deforms as the number of the discharged sheets stacked on the tray is increased, the diameter portion comes in contact with the stacked sheets and prevents the second roller from coming in contact with the stacked sheets.

15. The apparatus of claim 14, wherein the discharging roller is biased with a spring member so that the first roller is pressed against the stacked sheets with a predetermined pressing force.

16. The apparatus of claim 1 wherein, when the shifting operation to shift a sheet is conducted by the shift device, the driving device moves the lower guide plate and the pressing member to said first position and to said high position, respectively, and when the shifting operation has been completed, said driving device moves said lower guide plate to said second position and said pressing member to said low position.

* * * * *